US006679683B2

(12) United States Patent
Seibel et al.

(10) Patent No.: US 6,679,683 B2
(45) Date of Patent: Jan. 20, 2004

(54) DUAL VOLUME-RATIO SCROLL MACHINE

(75) Inventors: Stephen M. Seibel, Celina, OH (US); Michael M. Perevozchikov, Tipp City, OH (US); Norman Beck, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/195,280

(22) Filed: Jul. 15, 2002

(65) Prior Publication Data

US 2003/0012659 A1 Jan. 16, 2003

Related U.S. Application Data

(63) Continuation-in-part of application No. 09/688,549, filed on Oct. 16, 2000, now Pat. No. 6,419,457.

(51) Int. Cl.[7] ..... F04B 49/00

(52) U.S. Cl. ..... 417/213; 417/299; 418/55.4; 418/57

(58) Field of Search ..... 417/213, 299, 417/307, 308, 310, 440; 418/55.1, 55.4, 55.5, 57; 277/562, 570, 579

(56) References Cited

U.S. PATENT DOCUMENTS

| | | | | | |
|---|---|---|---|---|---|
| 4,383,805 | A | | 5/1983 | Teegarden et al. | 417/308 |
| 4,456,435 | A | | 6/1984 | Hiraga et al. | 417/302 |
| 4,468,178 | A | | 8/1984 | Hiraga et al. | 417/440 |
| 4,497,615 | A | | 2/1985 | Griffith | 417/310 |
| 4,514,150 | A | | 4/1985 | Hiraga et al. | 417/440 |
| 4,566,863 | A | | 1/1986 | Goto et al. | 417/295 |
| 4,642,034 | A | * | 2/1987 | Terauchi | 417/295 |
| 4,673,340 | A | | 6/1987 | Mabe et al. | 418/15 |
| 4,747,756 | A | | 5/1988 | Sato et al. | 417/307 |
| 4,955,795 | A | * | 9/1990 | Griffith | 417/44 |
| 5,074,760 | A | | 12/1991 | Hirooka et al. | 417/310 |
| 5,074,761 | A | | 12/1991 | Hirooka et al. | 417/310 |
| 5,141,407 | A | * | 8/1992 | Ramsey et al. | 417/292 |
| 5,192,195 | A | | 3/1993 | Iio et al. | 417/299 |
| 5,368,446 | A | * | 11/1994 | Rode | 417/18 |
| 5,447,420 | A | * | 9/1995 | Caillat et al. | 418/55.5 |
| 5,551,846 | A | | 9/1996 | Taylor et al. | 417/308 |
| 5,562,426 | A | | 10/1996 | Watanabe et al. | 417/310 |
| 5,603,614 | A | | 2/1997 | Sakata et al. | 418/55.2 |
| 5,649,816 | A | * | 7/1997 | Wallis et al. | 418/5.1 |
| 5,678,985 | A | | 10/1997 | Brooke et al. | 417/299 |
| 5,707,210 | A | | 1/1998 | Ramsey et al. | 417/32 |
| 5,951,272 | A | * | 9/1999 | Fukuhara et al. | 418/55.4 |
| 6,086,342 | A | | 7/2000 | Utter | 418/55.5 |
| 6,095,765 | A | | 8/2000 | Khalifa | 417/310 |
| 6,146,119 | A | * | 11/2000 | Bush et al. | 418/55.4 |
| 6,213,731 | B1 | * | 4/2001 | Doepket et al. | 417/310 |
| 6,293,767 | B1 | | 9/2001 | Bass | 417/310 |

* cited by examiner

*Primary Examiner*—Cheryl J. Tyler
*Assistant Examiner*—Han L Liu
(74) *Attorney, Agent, or Firm*—Harness, Dickey & Pierce, P.L.C.

(57) ABSTRACT

The present invention provides the art with a scroll machine which has a plurality of built-in volume ratios along with their respective design pressure ratios. The incorporation of more than one built-in volume ratio allows a single compressor to be optimized for more than one operating condition. The operating envelope for the compressor will determine which of the various built-in volume ratios is going to be selected. Each volume ratio includes a discharge passage extending between one of the pockets of the scroll machine and the discharge chamber. All but the highest volume ration utilize a valve controlling the flow through the discharge passage.

98 Claims, 13 Drawing Sheets

DUAL VOLUME-RATIO SCROLL MACHINE

CROSS-REFERENCE TO RELATED APPLICATIONS

This application is a continuation-in-part application of U.S. patent application Ser. No. 09/688,549 filed on Oct. 16, 2000 now U.S. Pat. No. 6,419,457. The disclosure of the above application is incorporated herein by reference.

FIELD OF THE INVENTION

The present invention relates to generally to scroll machines. More particularly, the present invention relates to a dual volume ratio scroll machine, having a multi-function seal system which utilizes flip or flip seals.

BACKGROUND AND SUMMARY OF THE INVENTION

A class of machines exists in the art generally known as scroll machines which are used for the displacement of various types of fluids. Those scroll machines can be configured as an expander, a displacement engine, a pump, a compressor, etc., and the features of the present invention are applicable to any one of these machines. For purposes of illustration, however, the disclosed embodiments are in the form of a hermetic refrigerant compressor.

Scroll-type apparatus have been recognized as having distinct advantages. For example, scroll machines have high isentropic and volumetric efficiency, and hence are small and lightweight for a given capacity. They are quieter and more vibration free than many compressors because they do not use large reciprocating parts (e.g. pistons, connecting rods, etc.). All fluid flow is in one direction with simultaneous compression in plural opposed pockets which results in less pressure-created vibrations. Such machines also tend to have high reliability and durability because of the relatively few moving parts utilized, the relatively low velocity of movement between the scrolls, and an inherent forgiveness to fluid contamination.

Generally speaking, a scroll apparatus comprises two spiral wraps of similar configuration, each mounted on a separate end plate to define a scroll member. The two scroll members are interfitted together with one of the scroll wraps being rotationally displaced 180 degrees from the other. The apparatus operates by orbiting one scroll member (the orbiting scroll member) with respect to the other scroll member (the non-orbiting scroll) to produce moving line contacts between the flanks of the respective wraps. These moving line contacts create defined moving isolated crescent-shaped pockets of fluid. The spiral scroll wraps are typically formed as involutes of a circle. Ideally, there is no relative rotation between the scroll members during operation, the movement is purely curvilinear translation (no rotation of any line on the body). The relative rotation between the scroll members is typically prohibited by the use of an Oldham coupling.

The moving fluid pockets carry the fluid to be handled from a first zone in the scroll machine where a fluid inlet is provided, to a second zone in the scroll machine where a fluid outlet is provided. The volume of the sealed pocket changes as it moves from the first zone to the second zone. At any one instant of time, there will be at least one pair of sealed pockets, and when there are several pairs of sealed pockets at one time, each pair will have different volumes. In a compressor, the second zone is at a higher pressure than the first zone and it is physically located centrally within the machine, the first zone being located at the outer periphery of the machine.

Two types of contacts define the fluid pockets formed between the scroll members. First, there is axially extending tangential line contacts between the spiral faces or flanks of the wraps caused by radial forces ("flank sealing"). Second, there are area contacts caused by axial forces between the plane edge surfaces (the "tips") of each wrap and the opposite end plate ("tip sealing"). For high efficiency, good sealing must be achieved for both types of contacts, however, the present invention is concerned with tip sealing.

To maximize efficiency, it is important for the wrap tips of each scroll member to sealingly engage the end plate of the other scroll so that there is minimum leakage therebetween. One way this has been accomplished, other than using tip seals (which are very difficult to assembly and which often present reliability problems) is by using fluid under pressure to axially bias one of the scroll members against the other scroll member. This of course, requires seals in order to isolate the biasing fluid at the desired pressure. Accordingly, there is a continuing need in the field of scroll machines for axial biasing techniques including improved seals to facilitate the axial biasing.

One aspect of the present invention provides the art with several unique sealing systems for the axial biasing chamber of a scroll-type apparatus. The seals of the present invention are embodied in a scroll compressor and suited for use in machines which use discharge pressure alone, discharge pressure and an independent intermediate pressure, or solely an intermediate pressure, in order to provide the necessary axial biasing forces to enhance tip sealing. In addition, the seals of the present invention are suitable particularly for use in applications which bias the non-orbiting scroll member towards the orbiting scroll member.

A typical scroll machine which is used as a scroll compressor for an air conditioning application is a single volume ratio device. The volume ratio of the scroll compressor is the ratio of the gas volume trapped at suction closing to the gas volume at the onset of discharge opening. The volume ratio of the typical scroll compressor is "built-in" since it is fixed by the size of the initial suction pocket and the length of the active scroll wrap. The built-in volume ratio and the type of refrigerant being compressed determine the single design pressure ratio for the scroll compressor where compression lossed due to pressure ratio mismatch is avoided. The design pressure ratio is generally chosen to closely match the primary compressor rating point, however, it may be biased towards a secondary rating point.

Scroll compressor design specifications for air conditioning applications typically include a requirement that the motor which drives the scroll members must be able to withstand a reduced supply voltage without overheating. While operating at this reduced supply voltage, the compressor must operate at a high-load operating condition. When the motor is sized to meet the reduced supply voltage requirement, the design changes to the motor will generally conflict with the desire to maximize the motor efficiency at the primary compressor rating point. Typically, the increasing of motor output torque will improve the low voltage operation of the motor but this will also reduce the compressor efficiency at the primary rating point. Conversely, any reduction that can be made in the design motor torque while still being able to pass the low-voltage specification allows the selection of a motor which will operate at a higher efficiency at the compressor primary rating point.

Another aspect of the present invention improves the operating efficiency of the scroll compressor through the existence of a plurality of built-in volume ratios and their corresponding design pressure ratios. For exemplary purposes, the present invention is described in a compressor having two built-in volume ratios and two corresponding design pressure ratios. It is to be understood that additional built-in volume ratios and corresponding design pressure ratios could be incorporated into the compressor if desired.

Other advantages and objects of the present invention will become apparent to those skilled in the art from the subsequent detailed description, appended claims and drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Although the principles of the present invention may be applied to many different types of scroll machines, they are described herein, for exemplary purposes, embodied in a hermetic scroll compressor, and particularly one which has been found to have specific utility in the compression of refrigerant for air conditioning and refrigeration systems.

Figure 1:
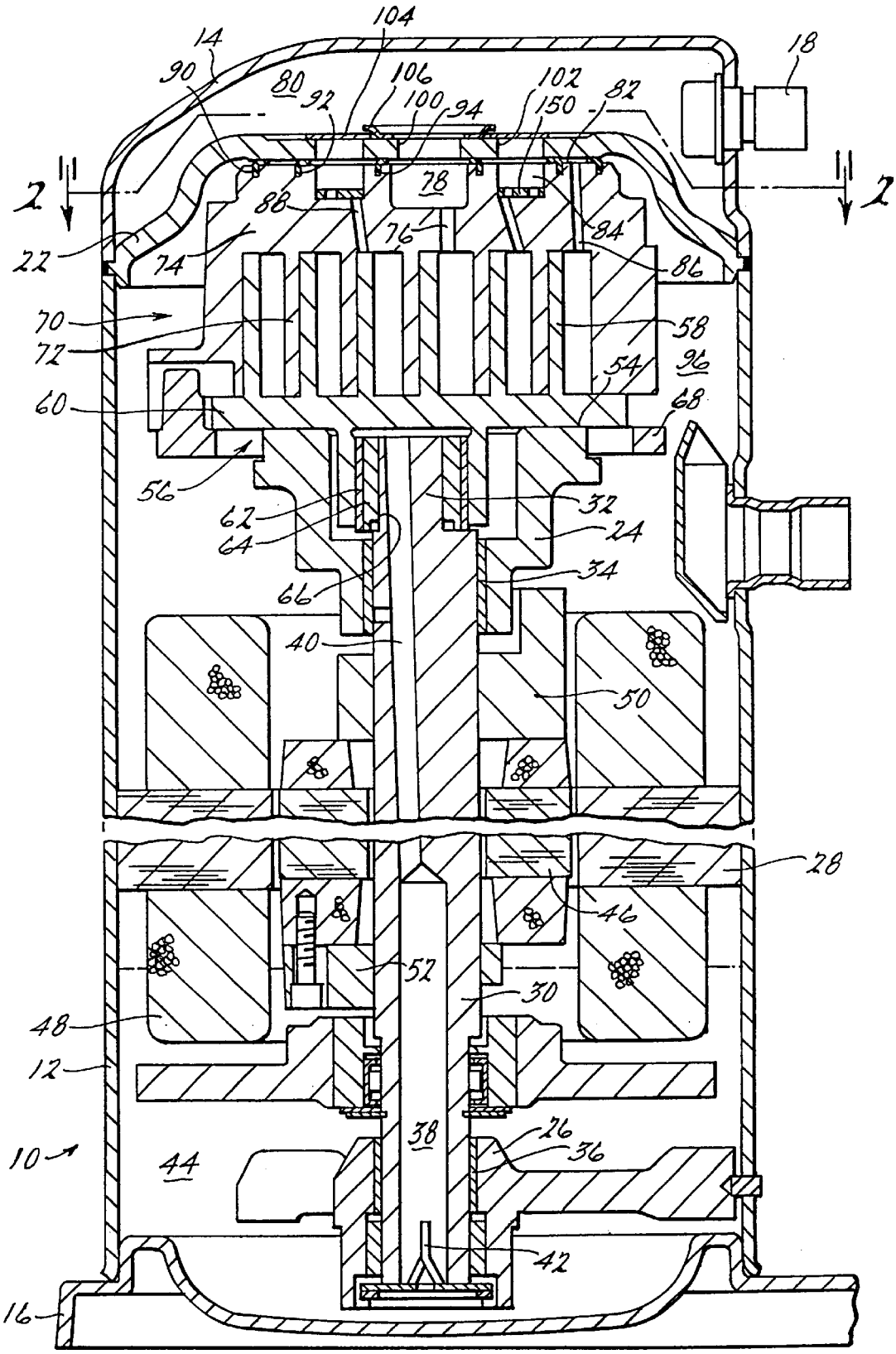
FIG. 1 is a vertical sectional view of a scroll type refrigerant compressor incorporating the sealing system and the dual volume ratio in accordance with the present invention.
Figure 2:
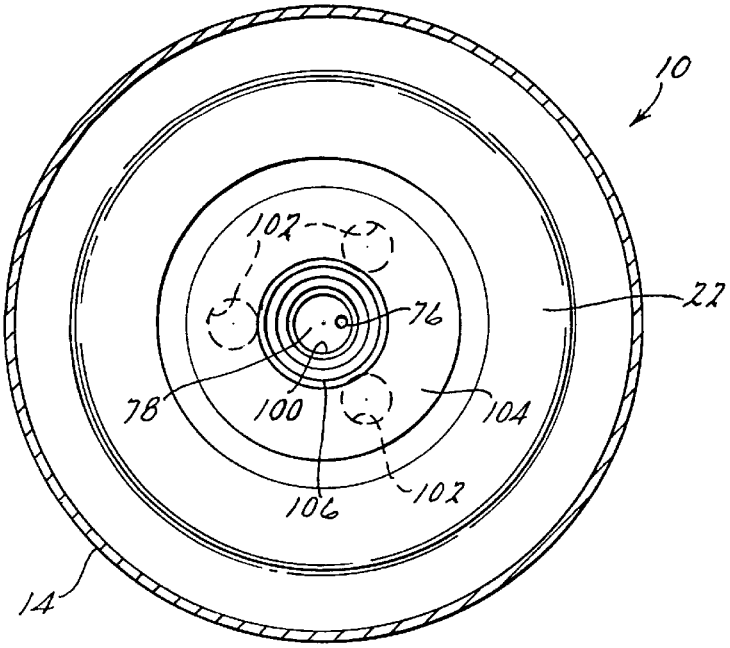
FIG. 2 is a cross-sectional view of the refrigerant compressor shown in FIG. 1, the section being taken along line 2—2 thereof.

The following description of the preferred embodiment(s) is merely exemplary in nature and is in no way intended to limit the invention, its application, or uses. Referring now to the drawings in which like reference numerals designate like or corresponding parts throughout the several views, there is shown in FIGS. 1 and 2 a scroll compressor incorporating a unique dual volume-ratio system in accordance with the present invention and which is designated generally by the reference numeral 10. Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 having a plurality of radially outwardly extending legs each of which is also suitably secured to shell 12. A motor stator 28 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 defines an oil sump 44 which is filled with lubricating oil to a level slightly above the lower end of a rotor 46, and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 48 passing therethrough and rotor 46 press fitted on crankshaft 30 and having upper and lower counterweights 50 and 52, respectively.

The upper surface of main bearing housing 24 is provided with an annular flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and bearing housing 24 and keyed to orbiting scroll member 56 and a non-orbiting scroll member 70 to prevent rotational movement of orbiting scroll member 56.

Non-orbiting scroll member 70 is also provided having a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which in turn is in fluid communication with a discharge muffler chamber 80 defined by cap 14 and partition 22. A first and a second annular recess 82 and 84 are also formed in non-orbiting scroll member 70. Recesses 82 and 84 define axial pressure biasing chambers which receive pressurized fluid being compressed by wraps 58 and 72 so as to exert an axial biasing force on non-orbiting scroll member 70 to thereby urge the tips of respective wraps 58, 72 into sealing engagement with the opposed end plate surfaces of end plates 74 and 60, respectively. Outermost recess 82 receives pressurized fluid through a passage 86 and innermost recess 84 receives pressurized fluid through a plurality of passages 88. Disposed between non-orbiting scroll member 70 and partition 22 are three annular pressure actuated flip seals 90, 92 and 94. Seals 90 and 92 isolate outermost recess 82 from a suction chamber 96 and innermost recess 84 while seals 92 and 94 isolate innermost recess 84 from outermost recess 82 and discharge chamber 80.

Muffler plate 22 includes a centrally located discharge port 100 which receives compressed refrigerant from recess 78 in non-orbiting scroll member 70. When compressor 10 is operating at its full capacity or at its highest design pressure ratio, port 100 discharges compressed refrigerant to discharge chamber 80. Muffler plate 22 also includes a plurality of discharge passages 102 located radially outward from discharge port 100. Passages 102 are circumferentially spaced at a radial distance where they are located above innermost recess 84. When compressor 10 is operating at its reduced capacity or at its lower design pressure ratio, passages 102 discharge compressed refrigerant to discharge chamber 80. The flow of refrigerant through passages 102 is controlled by a valve 104 mounted on partition 22. A valve stop 106 positions and maintains valve 104 on muffler plate 22 such that it covers and closes passages 102.

Figure 3:
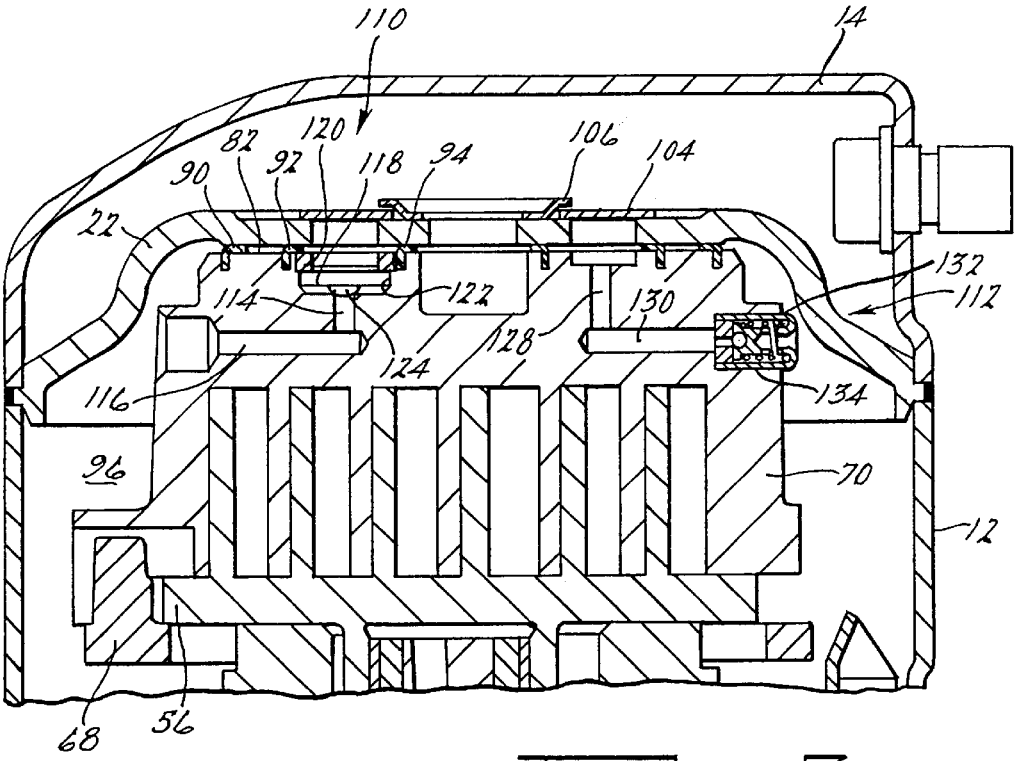
FIG. 3 is a partial vertical sectional view of the scroll type refrigerant compressor shown in FIG. 1 illustrating the pressure relief systems incorporated into the compressor.
Figure 4:
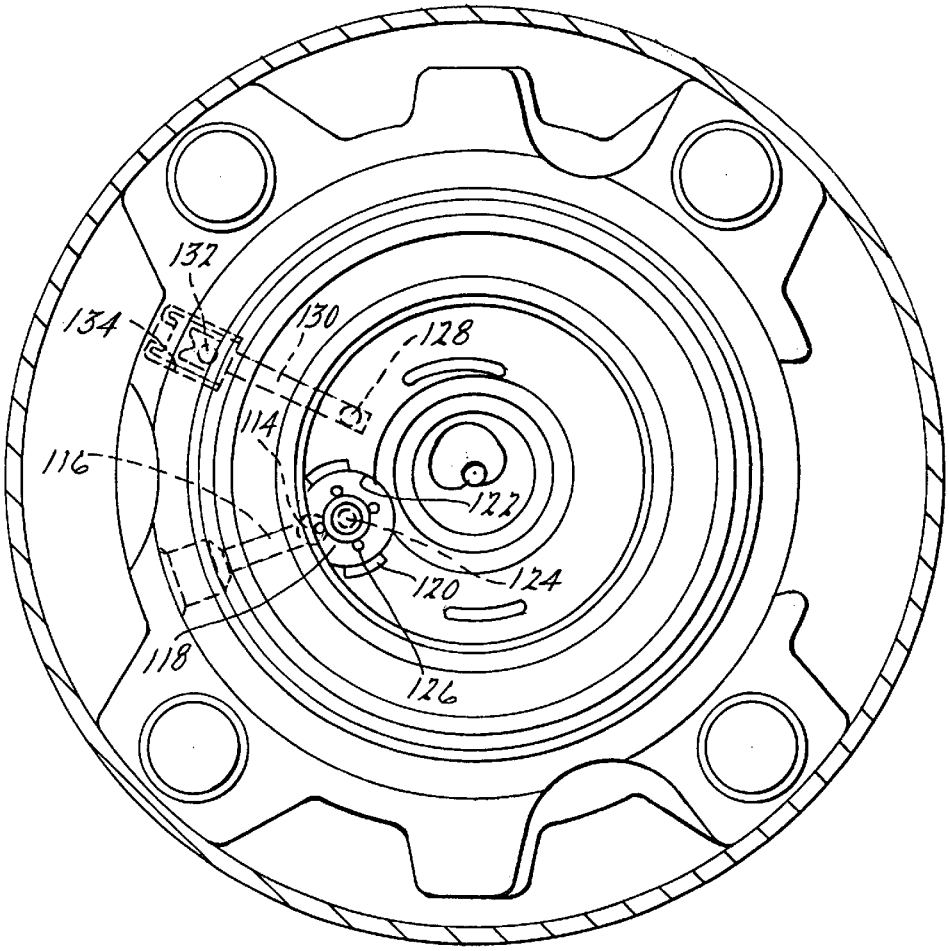
FIG. 4 is a cross-sectional view of the refrigerant compressor shown in FIG. 1, the section being taken along line 2—2 thereof with the partition removed.

Referring now to FIGS. 3 and 4, a temperature protection system 110 and a pressure relief system 112 are illustrated. Temperature protection system 110 comprises an axially extending passage 114, a radially extending passage 116, a bimetallic disc 118 and a retainer 120. Axial passage 114 intersects with radial passage 116 to connect recess 84 with suction chamber 96. Bi-metallic disc 118 is located within a circular bore 122 and it includes a centrally located indentation 124 which engages axial passage 114 to close passage 114. Bi-metallic disc 118 is held in position within bore 122 by retainer 120. When the temperature of refrigerant in recess 84 exceeds a predetermined temperature, bi-metallic disc 118 will snap open or move into a domed shape to space indentation 124 from passage 114. Refrigerant will then flow from recess 84 through a plurality of holes 126 in disc 118 into passage 114 into passage 116 and into suction chamber 96. The pressurized gas within recess 82 will vent to recess 84 due to the loss of sealing for annular seal 92.

When the pressurized gas within recess 84 is vented, annular seal 92 will lose sealing because it, like seals 90 and 94, are energized in part by the pressure differential between adjacent recesses 82 and 84. The loss of pressurized fluid in recess 84 will thus cause fluid to leak between recess 82 and recess 84. This will result in the removal of the axial biasing force provided by pressurized fluid within recesses 82 and 84 which will in turn allow separation of the scroll wrap tips with the opposing end plate resulting in a leakage path between discharge chamber 80 and suction chamber 96. This leakage path will tend to prevent the build up of excessive temperatures within compressor 10.

Pressure relief system 112 comprises an axially extending passage 128, a radially extending passage 130 and a pressure relief valve assembly 132. Axial passage 128 intersects with radial passage 130 to connect recess 84 with suction chamber 96. Pressure relief valve assembly 132 is located within a circular bore 134 located at the outer end of passage 130. Pressure relief valve assembly 132 is well known in the art and will therefore not be described in detail. When the pressure of refrigerant within recess 84 exceeds a predetermined pressure, pressure relief valve assembly 132 will open to allow fluid flow between recess 84 and suction chamber 96. The venting of fluid pressure by valve assembly 132 will affect compressor 10 in the same manner described above for temperature protection system 110. The leakage path which is created by valve assembly 132 will tend to prevent the build-up of excessive pressures within compressor 10. The response of valve assembly 132 to excessive discharge pressures is improved if the compressed pocket that is in communication with recess 84 is exposed to discharge pressure for a portion of the crank cycle. This is the case if the length of the active scroll wraps 58 and 72 needed to compress between an upper design pressure ratio 140 and a lower design pressure 142 (FIG. 5) is less then 360°.

Figure 5:
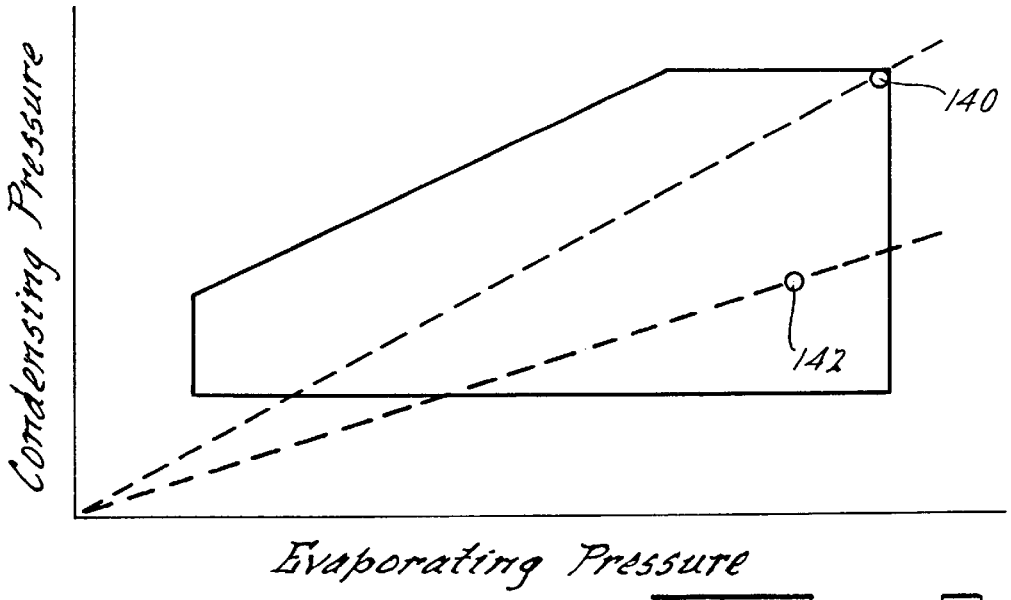
FIG. 5 is a typical compressor operating envelope for an air-conditioning application with the two design pressure ratios being identified.

Referring now to FIG. 5, a typical compressor operating envelope for an air conditioning application is illustrated. Also shown are the relative locations for upper design pressure ratio 140 and lower design pressure ratio 142. Upper design pressure ratio 140 is chosen to optimize operation of compressor 10 at the motor low-voltage test point. When compressor 10 is operating at this point, the refrigerant being compressed by scroll members 56 and 70 enter discharge chamber 80 through discharge passage 76, recess 78 and discharge port 100. Discharge passages 102 are closed by valve 104 which is urged against partition 22 by the fluid pressure within discharge chamber 80. Increasing the overall efficiency of compressor 10 at design pressure ratio 140 allows the design motor torque to be reduced which yields increased motor efficiency at the rating point. Lower design pressure ratio 142 is chosen to match the rating point for compressor 10 to further improve efficiency.

Thus, if the operating point for compressor 10 is above lower design pressure ratio 142, the gas within the scroll pockets is compressed along the full length of wraps 58 and 72 in the normal manner to be discharged through passage 76, recess 78 and port 100. If the operating point for compressor 10 is at or below lower design pressure ratio 142, the gas within the scroll pockets is able to discharge through passages 102 by opening valve 104 before reaching the inner ends of scroll wraps 58 and 72. This early discharging of the gas avoids losses due to compression ratio mismatch.

Outermost recess 82 acts in a typical manner to offset a portion of the gas separating forces in the scroll compression pockets. The fluid pressure within recess 82 axially bias the vane tips of non-orbiting scroll member 70 into contact with end plate 60 of orbiting scroll member 56 and the vane tips of orbiting scroll member 56 into contact with end plate 74 of non-orbiting scroll member 70. Innermost recess 84 acts in this typical manner at a reduced pressure when the operating condition of compressor 10 is below lower design pressure ratio 142 and at an increased pressure when the operating condition of compressor 10 is at or above lower design pressure ratio 142. In this mode, recess 84 can be used to improve the axial pressure balancing scheme since it provides an additional opportunity to minimize the tip contact force.

Figure 6:
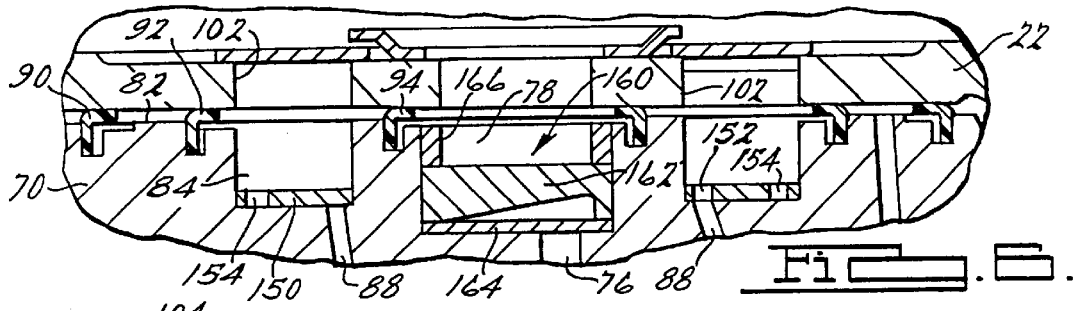
FIG. 6 is an enlarged view of a portion of a compressor in accordance with another embodiment of the present invention.

In order to minimize the re-expansion losses created by axial passages 88 and 102 used for early discharge end, the volume defined by innermost recess 84 should be held to a minimum. An alternative to this would be to incorporate a baffle plate 150 into recess 84 as shown in FIGS. 1 and 6. Baffle plate 150 controls the volume of gas that passes into recess 84 from the compression pockets. Baffle plate 150 operates similar to the way that valve plate 104 operates. Baffle plate 150 is constrained from angular motion but it is capable of axial motion within recess 84. When baffle plate 150 is at the bottom of recess 84 in contact with non-orbiting scroll member 70, the flow of gas into recess 84 is minimized. Only a very small bleed hole 152 connects the compression pocket with recess 84. Bleed hole 152 is in line with one of the axial passages 88. Thus, expansion losses are minimized. When baffle plate 150 is spaced from the bottom of recess 84, sufficient gas flow for early discharging flows through a plurality of holes 154 offset in baffle plate 150. Each of the plurality of holes 154 is in line with a respective passage 102 and not in line with any of passages 88. When using baffle plate 150 and optimizing the response of pressure relief valve assembly 132 by having an active scroll length of 360° between ratios 140 and 142 as described above, the trade off for this increased response will be the possibility of the opening of baffle plate 150.

Referring now to FIG. 6, an enlarged section of recesses 78 and 84 of non-orbiting scroll member 70 is illustrated according to another embodiment of the present invention. In this embodiment, a discharge valve 160 is located within recess 78. Discharge valve 160 includes a valve seat 162, a valve plate 164 and a retainer 166.

Figure 7:
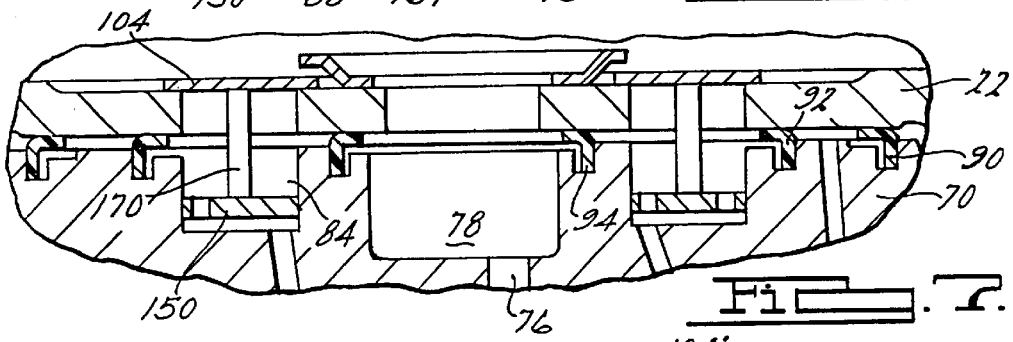
FIG. 7 is an enlarged view of a portion of a compressor in accordance with another embodiment of the present invention.

Referring now to FIG. 7, an enlarged section of recesses 78 and 84 of non-orbiting scroll member 70 is illustrated according to another embodiment of the present invention. In this embodiment valve 104 and baffle plate 150 are connected by a plurality of connecting members 170. Connecting members 170 require that valve 104 and baffle plate 150 move together. The benefit to connecting valve 104 and baffle plate 150 is to avoid any dynamic interaction between the two.

Figure 8:
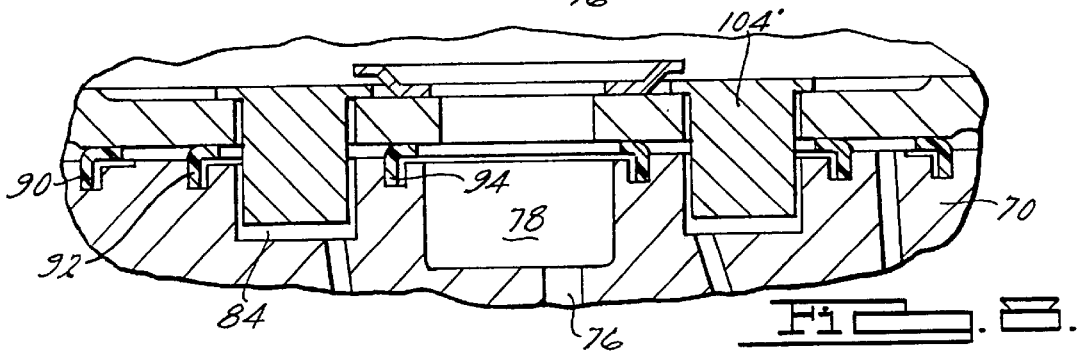
FIG. 8 is an enlarged view of a portion of a compressor in accordance with another embodiment of the present invention.

Referring now to FIG. 8, an enlarged section of recesses 78 and 84 of non-orbiting scroll member 70 is illustrated according to another embodiment of the present invention. In this embodiment valve 104 and baffle plate 150 are replaced with a single unitary valve 104'. Using single unitary valve 104' has the same advantages as those described for FIG. 7 in that dynamic interaction is avoided.

Figure 9:
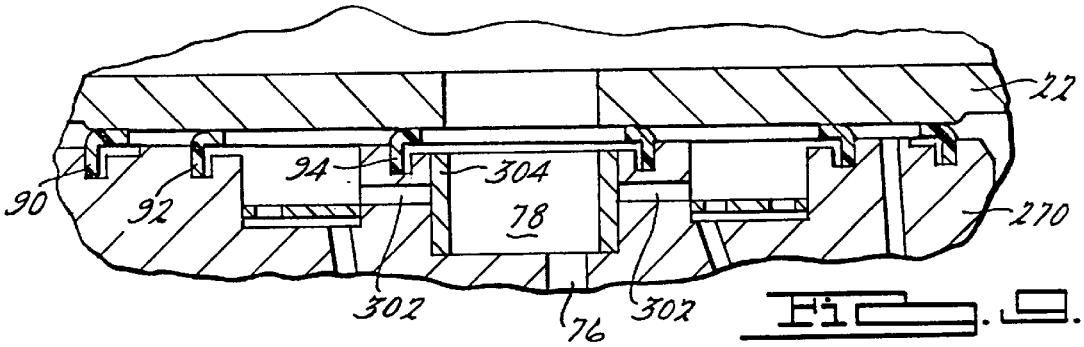
FIG. 9 is an enlarged view of a portion of a compressor in accordance with another embodiment of the present invention.

Referring now to FIG. 9, an enlarged section of recesses 78 and 84 of a non-orbiting scroll member 270 is illustrated according to another embodiment of the present invention. Scroll member 270 is identical to scroll member 70 except that a pair of radial passages 302 replace the plurality of passages 102 through partition 22. In addition, a curved flexible valve 304 located along the perimeter of recess 78 replaces valve 104. Curved flexible valve 304 is a flexible cylinder which is designed to flex and thus to open radial passages 302 in a similar manner with the way that valve 104 opens passages 102. The advantage to this design is that a standard partition 22 which does not include passages 102 can be utilized. While this embodiment discloses radial passage 302 and flexible valve 304, it is within the scope of the present invention to eliminate passage 302 and valve 304 and design flip seal 94 to function as the valve between innermost recess 84 and discharge chamber 80. Since flip 94 is a pressure actuated seal, the higher pressure within discharge chamber 80 over the pressure within recess 84 actuates flip seal 94. Thus, if the pressure within recess 84 would exceed the pressure within discharge chamber 80, flip seal 94 could be designed to open and allow the passage of the high pressure gas.

Figure 10:
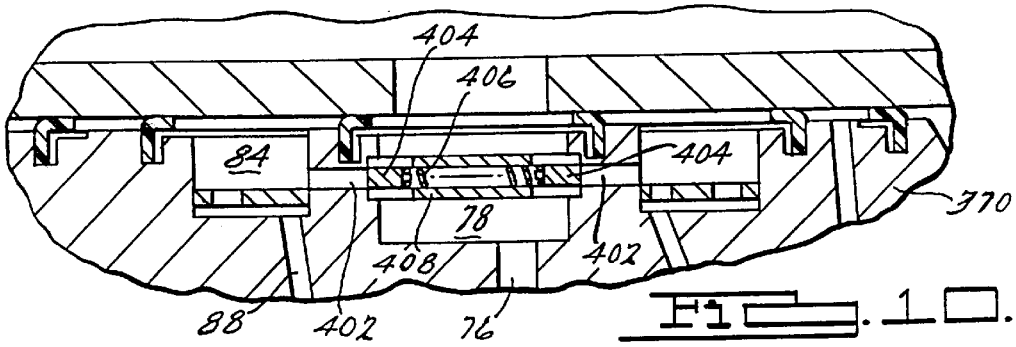
FIG. 10 is an enlarged view of a portion of a compressor in accordance with another embodiment of the present invention.
Figure 11:
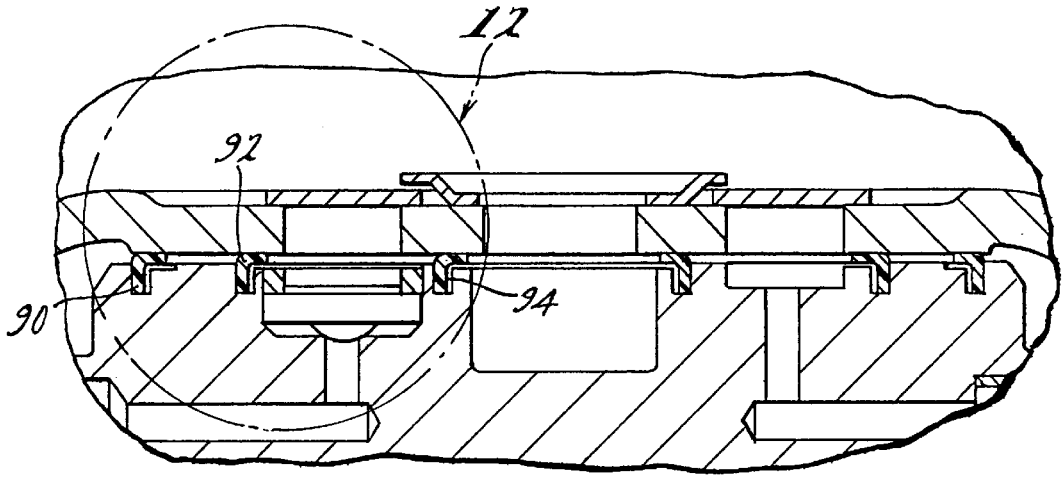
FIG. 11 is an enlarged plan view of a portion of the sealing system according to the present invention shown in FIG. 3.

Referring now to FIG. 10, an enlarged section of recesses 78 and 84 of a non-orbiting scroll member 370 is illustrated according to another embodiment of the present invention. Scroll member 370 is identical to scroll member 70 except that the pair of radial passages 402 replace the plurality of passages 102 through partition 22. In addition, a valve 404 is biased against passages 402 by a retaining spring 406. A valve guide 408 controls the movement of valves 404. Valves 404 are designed to open radial passages 402 in a similar manner with the way that valve 104 opens passages 102. The advantage to this design is again that a standard partition 22 which does not include passages 102 can be utilized.

While not specifically illustrated, it is within the scope of the present invention to configure each of valves 404 such that they perform the function of both opening passages 402 and minimize the re-expansion losses created through passages 88 in a manner equivalent to that of baffle plate 150.

Figure 12:
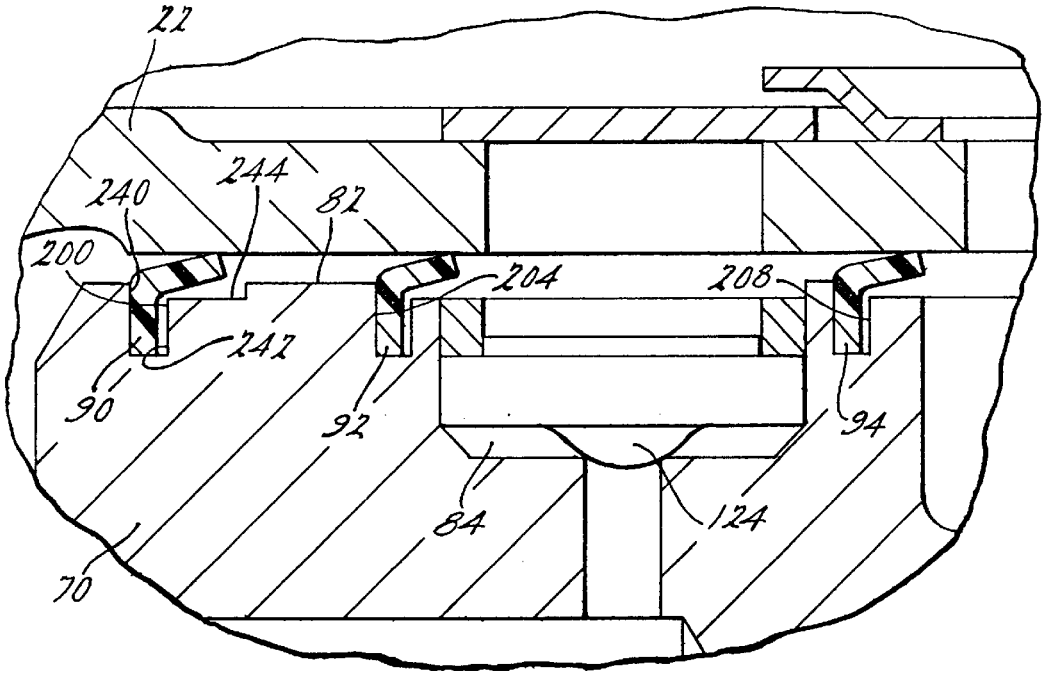
FIG. 12 is an enlarged vertical sectional view of circle 12 shown in FIG. 11.

With reference to FIGS. 1, 2, 11 and 12, flip seals 90, 92 and 94 are each configured during installation as an annular L-shaped seal. Outer flip seal 90 is disposed within a groove 200 located within non-orbiting scroll member 70. One leg of flip seal 90 extends into groove 200 while the other leg extends generally horizontal, as shown in FIGS. 1, 2 and 12 to provide sealing between non-orbiting scroll member 70 and muffler plate 22. Flip seal 90 functions to isolate recess 82 from the suction area of compressor 10. The initial forming diameter of flip seal 90 is less than the diameter of groove 200 such that the assembly of flip seal 90 into groove 200 requires stretching of flip seal 90. Preferably, flip seal 90 is manufactured from a Teflon® material containing 10% glass when interfacing with steel components.

Center flip seal 92 is disposed within a groove 204 located within non-orbiting scroll member 70. One leg of flip seal 92 extends into groove 204 while the other leg extends generally horizontal, as shown in FIGS. 1, 2 and 12 to provide sealing between non-orbiting scroll member 70 and muffler plate 22. Flip seal 92 functions to isolate recess 82 from the bottom of recess 84. The initial forming diameter of flip seal 92 is less than the diameter of groove 204 such that the assembly of flip seal 92 into groove 204 requires stretching of flip seal 92. Preferably, flip seal 92 is manufactured from a Teflon® material containing 10% glass when interfacing with steel components.

Inner flip seal 94 is disposed within a groove 208 located within non-orbiting scroll member 70. One leg of flip seal 94 extends into groove 208 while the other leg extends generally horizontal, as shown in FIGS. 1, 2 and 12 to provide sealing between non-orbiting scroll member 70 and muffler plate 22. Flip seal 94 functions to isolate recess 84 from the discharge area of compressor 10. The initial forming diameter area of flip seal 94 is less than the diameter of groove 208 such that the assembly of flip seal 94 into groove 208 requires stretching of flip seal 94. Preferably, flip seal 94 is manufactured from a Teflon® material containing 10% glass when interfacing with steel components.

Seals 90, 92 and 94 therefore provide three distinct seals; namely, an inside diameter seal of seal 94, an outside diameter seal of seal 90, and a middle diameter seal of seal 92. The sealing between muffler plate 22 and seal 94 isolates fluid under intermediate pressure in recess 84 from fluid under discharge pressure. The sealing between muffler plate 22 and seal 90 isolates fluid under intermediate pressure in recess 82 from fluid under suction pressure. The sealing between muffler plate 22 and seal 92 isolates fluid under intermediate pressure in recess 84 from fluid under a different intermediate pressure in recess 82. Seals 90, 92 and 94 are pressure activated seals as described below.

Grooves 200, 204 and 208 are all similar in shape. Groove 200 will be described below. It is to be understood that grooves 204 and 208 include the same features as groove 200. Groove 200 includes a generally vertical outer wall 240, a generally vertical inner wall 242 and an undercut portion 244. The distance between walls 240 and 242, the width of groove 200, is designed to be slightly larger than the width of seal 90. The purpose for this is to allow pressurized fluid from recess 82 into the area between seal 90 and wall 242. The pressurized fluid within this area will react against seal 90 forcing it against wall 240 thus enhancing the sealing characteristics between wall 240 and seal 90. Undercut 244 is positioned to lie underneath the generally horizontal portion of seal 90 as shown in FIG. 12. The purpose for undercut 244 is to allow pressurized fluid within recess 82 to act against the horizontal portion of seal 92 urging it against muffler plate 22 to enhance its sealing characteristics. Thus, the pressurized fluid within recess 82 reacts against the inner surface of seal 90 to pressure activate seal 90. As stated above, grooves 204 and 208 are the same as groove 200 and therefore provide the same pressure activation for seals 92 and 94. FIGS. 23A–23H illustrate additional configurations for grooves 200, 204 and 208.

The unique installed L-shaped configuration of seals 90, 92 and 94 of the present invention are relatively simple in construction, easy to install and inspect, and effectively provide the complex sealing functions desired. The unique sealing system of the present invention comprises three flip seals 90, 92 and 94 that are "stretched" into place and then pressure activated. The unique seal assembly of the present invention reduces overall manufacturing costs for the compressor, reduces the number of components for the seal assembly, improves durability by minimizing seal wear and provides room to increase the discharge muffler volume for improved damping of discharging pulse without increasing the overall size of the compressor.

The seals of the present invention also provide a degree of relief during flooded starts. Seals 90, 92 and 94 are designed to seal in only one direction. These seals can then be used to relieve high pressure fluid from the intermediate chambers or recesses 82 and 84 to the discharge chamber during flooded starts, thus reducing inter-scroll pressures and the resultant stress and noise.

Figure 13:
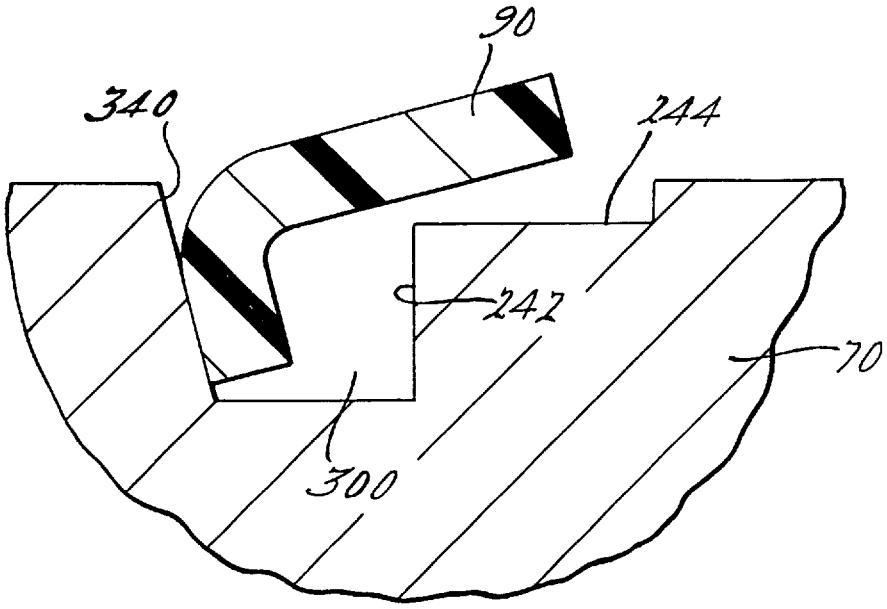
FIG. 13 is a cross-sectional view of a seal groove in accordance with another embodiment of the present invention.

Referring now to FIG. 13, a groove 300 in accordance with another embodiment of the present invention is illustrated. Groove 300 includes an outwardly angled outer wall 340, generally vertical inner wall 242 and undercut portion 244. Thus, groove 300 is the same as groove 200 except that the outwardly angled outer wall 340 replaces generally vertical outer wall 240. The function, operation and advantages of groove 300 and seal 90 are the same as groove 200 and seal 90 detailed above. The angling of the outer wall enhances the ability of the pressurized fluid within recess 82 to react against the inner surface of seal 90 to pressure activate seal 90. It is to be understood that grooves 200, 204 and 208 can each be configured the same as groove 300.

Figure 14:
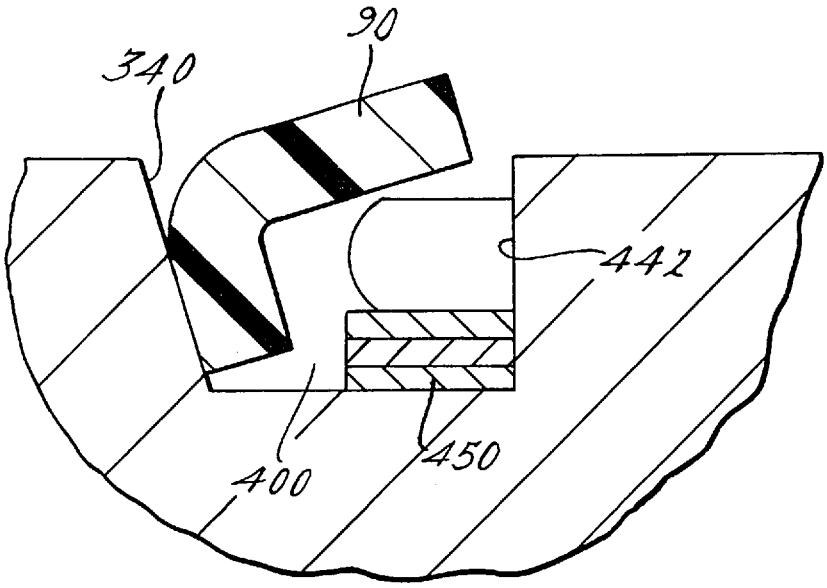
FIG. 14 is a cross-sectional view of a seal groove in accordance with another embodiment of the present invention.

Referring now to FIG. 14, a seal groove 400 in accordance with another embodiment of the present invention is illustrated. Groove 400 includes outwardly angled outer wall 340 and a generally vertical inner wall 442. Thus, groove 400 is the same as groove 300 except that undercut portion 244 has been removed. The function, operation and advantages of groove 300 and seal 90 are the same as grooves 200 and 300 and seal 90 as detailed above. The elimination of undercut portion 244 is made possible by the incorporation of a wave spring 450 underneath seal 90. Wave spring 450 biases the horizontal portion of seal 90 upward toward muffler plate 22 to provide a passage for the pressurized gas within recess 82 to react against the inner surface of seal 90 to pressure activate seal 90. It is to be understood that grooves 200, 204 and 208 can each be configured the same as groove 400.

Figure 15:
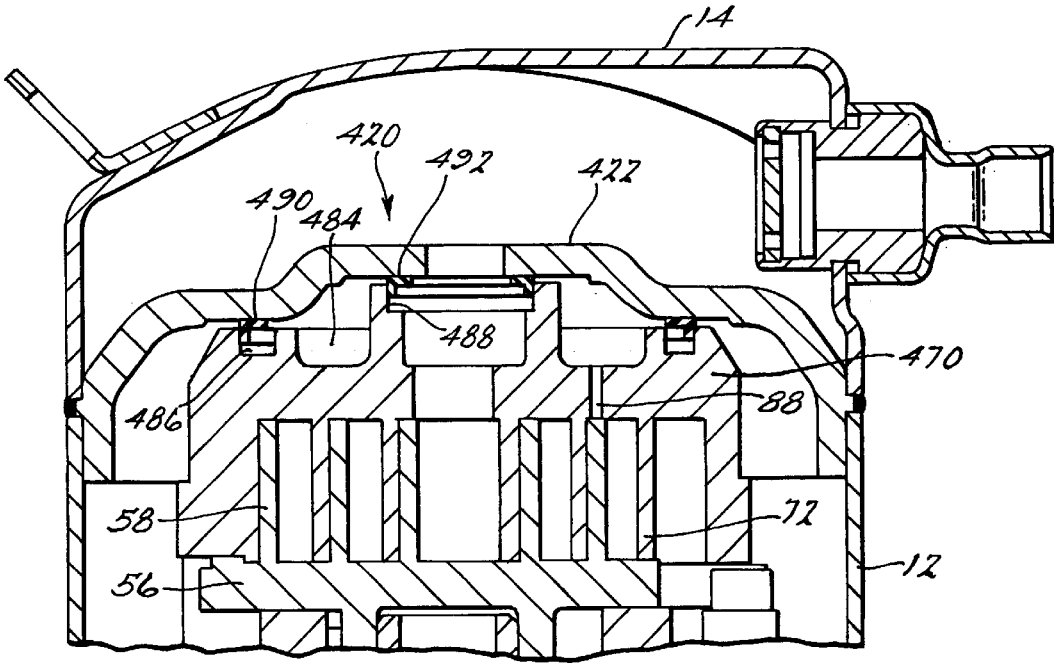
FIG. 15 is a partial vertical sectional view of a scroll type refrigerant compressor incorporating a sealing system in accordance with another embodiment of the present invention.

Referring now to FIG. 15, a sealing system 420 in accordance with another embodiment of the present invention is illustrated. Sealing system 420 seals fluid pressure between a partition 422 and a non-orbiting scroll member 470. Non-orbiting scroll member 470 is designed to replace non-orbiting scroll member 70 or any other of the non-orbiting scroll members described. In a similar manner, partition 422 is designed to replace partition 22 in the above-described compressors.

Non-orbiting scroll member 470 includes scroll wrap 72 and it defines an annular recess 484, an outer seal groove 486 and an inner seal groove 488. Annular recess 484 is located between outer seal groove 486 and inner seal groove 488 and it is provided compressed fluid through fluid passage 88 which opens to a fluid pocket defined by non-orbiting scroll wrap 72 of non-orbiting scroll member 470 and orbiting scroll wrap 58 of orbiting scroll member 56. The pressurized fluid provided through fluid passage 88 is at a pressure which is intermediate or in between the suction pressure and the discharge pressure of the compressor. The fluid pressure within annular recess 484 biases non-orbiting scroll member 470 towards orbiting scroll member 56 to enhance the tip sealing characteristics between the two scroll members.

A flip seal 490 is disposed within outer seal groove 486 and a flip seal 492 is disposed within inner seal groove 488. Flip seal 490 sealingly engages non-orbiting scroll member 470 and partition 422 to isolate annular recess 484 from suction pressure. Flip seal 492 sealing engages non-orbiting scroll member 470 and partition 422 to isolate annular recess 484 from discharge pressure. While not illustrated in FIG. 15, non-orbiting scroll member 470 can include temperature protection system 110. Also, while not illustrated, non-orbiting scroll member 470 can also include pressure relief system 112 if desired.

Figure 16:
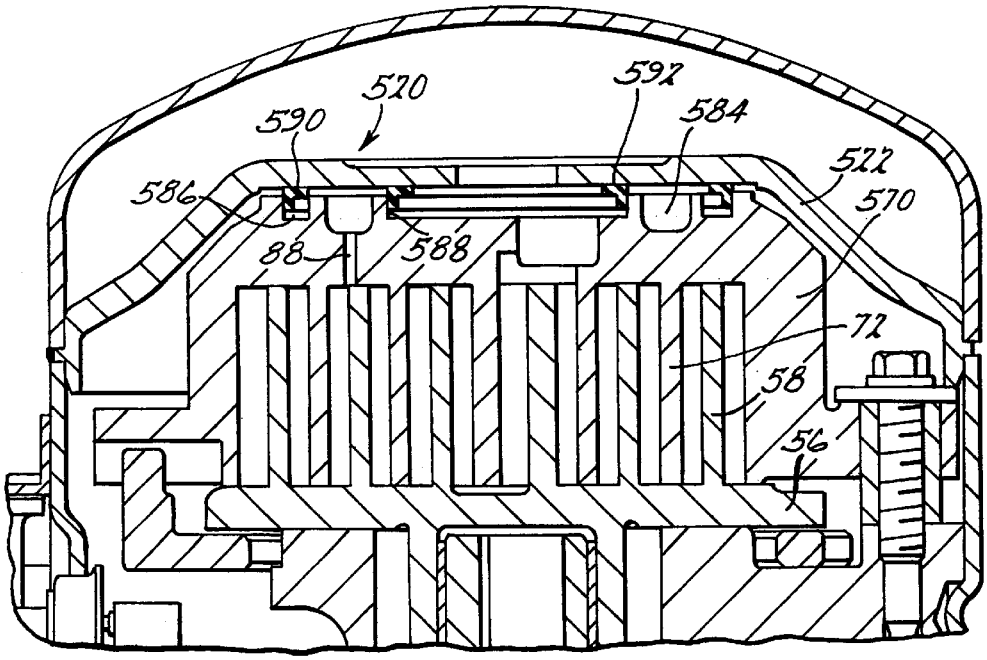
FIG. 16 is a partial vertical sectional view of a scroll type refrigerant compressor incorporating a sealing system in accordance with another embodiment of the present invention.

Referring now to FIG. 16, a sealing system 520 in accordance with another embodiment of the present invention is illustrated. Sealing system 520 seals fluid pressure between a partition 522 and a non-orbiting scroll member 570. Non-orbiting scroll member 570 is designed to replace non-orbiting scroll member 70 or any other of the non-orbiting scroll members described. In a similar manner, partition 522 is designed to replace partition 22 or any of the other of the previously described partitions.

Non-orbiting scroll member 570 includes scroll wrap 72 and it defines an annular recess 584, an outer seal groove 586 and an inner seal groove 588. Annular recess 584 is located between outer seal groove 586 and inner seal groove 588 and it is provided with compressed fluid through fluid passage 88 which opens to a fluid pocket defined by non-orbiting scroll wrap 72 of non-orbiting scroll member 570 and orbiting scroll wrap 58 of orbiting scroll member 56. The pressurized fluid provided through fluid passage 88 is at a pressure which is intermediate or in between the suction pressure and the discharge pressure of the compressor. The fluid pressure within annular recess 586 biases non-orbiting scroll member 570 towards orbiting scroll member 56 to enhance the tip scaling characteristics between the two scroll members.

A flip seal 590 is disposed within outer seal groove 586 and a flip seal 592 is disposed within inner seal groove 588. Flip seal 590 sealingly engages non-orbiting scroll member 570 and partition 522 to isolate annular recess 584 from suction pressure. Flip seal 592 sealingly engages non-orbiting scroll member 570 and partition 522 to isolate annular recess 584 from discharge pressure. While not specifically illustrated in FIG. 16, non-orbiting scroll member 570 can include temperature protection system 110. Also, while not illustrated, non-orbiting scroll member 570 can also include pressure relief system 112 if desired.

Figure 17:
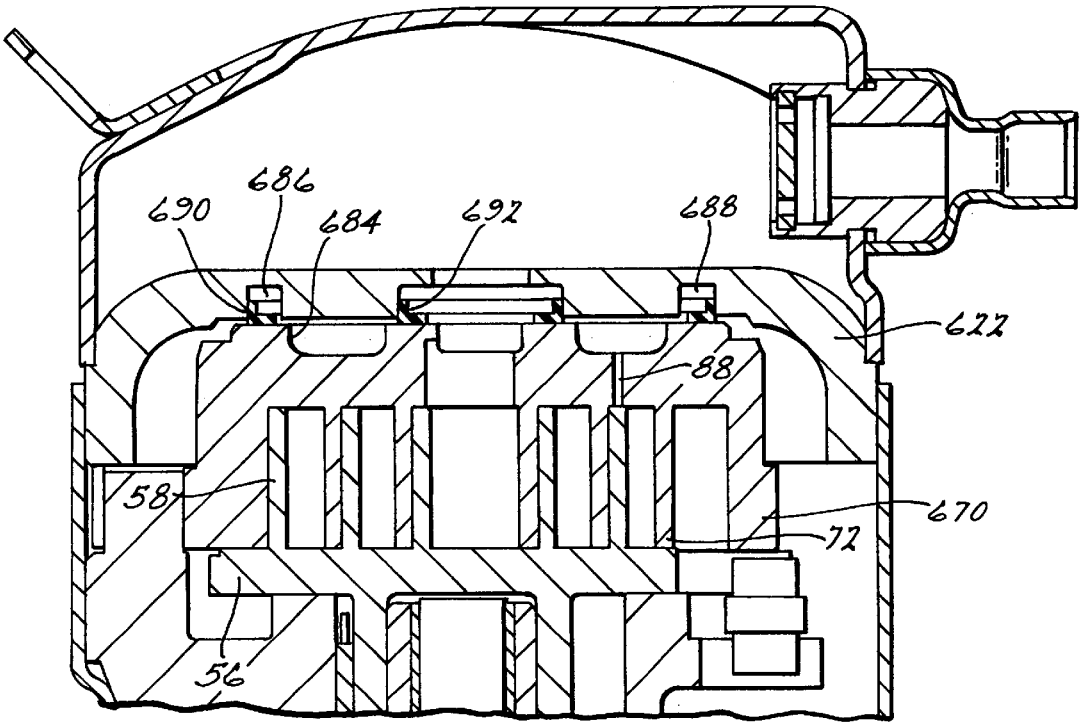
FIG. 17 is a partial vertical sectional view of a scroll type refrigerant compressor incorporating a sealing system in accordance with another embodiment of the present invention.

Referring now to FIG. 17, a sealing system 620 in accordance with another embodiment of the present invention is illustrated. Sealing system 620 seals fluid pressure between a partition 622 and a non-orbiting scroll member 670. Non-orbiting scroll member 670 is designed to replace non-orbiting scroll member 70 or any other of the non-orbiting scroll members described. In a similar manner, partition 622 is designed to replace partition 22 or any other of the previously described partitions.

Non-orbiting scroll member 670 includes scroll wrap 72 and it defines an annular recess 684. Partition 622 defines an outer seal groove 686 and an inner seal groove 688. Annular recess 684 is located between outer seal groove 686 and inner seal groove 688 and it is provided compressed fluid through fluid passage 88 which opens to a fluid pocket defined by non-orbiting scroll wrap 72 of non-orbiting scroll member 670 and orbiting scroll wrap 58 of orbiting scroll member 56. The pressurized fluid provided through fluid passage 88 is at a pressure which is intermediate or in between the suction pressure and the discharge pressure of the compressor. The fluid pressure within recess 684 biases non-orbiting scroll member 270 towards orbiting scroll member 56 to enhance the tip sealing characteristics between the two scroll members.

A flip seal 690 is disposed within outer seal groove 686 and a flip seal 692 is disposed within inner seal groove 608. Flip seal 690 sealingly engages non-orbiting scroll member 670 and partition 622 to isolate annular recess 684 from suction pressure. Flip seal 692 sealing engages non-orbiting scroll member 670 and partition 622 to isolate annular recess 684 from discharge pressure. While not specifically illustrated in FIG. 17, non-orbiting scroll member 670 can include temperature protection system 110. Also, while not illustrated, non-orbiting scroll member 670 can also include pressure relief system 112 if desired.

Figure 18:
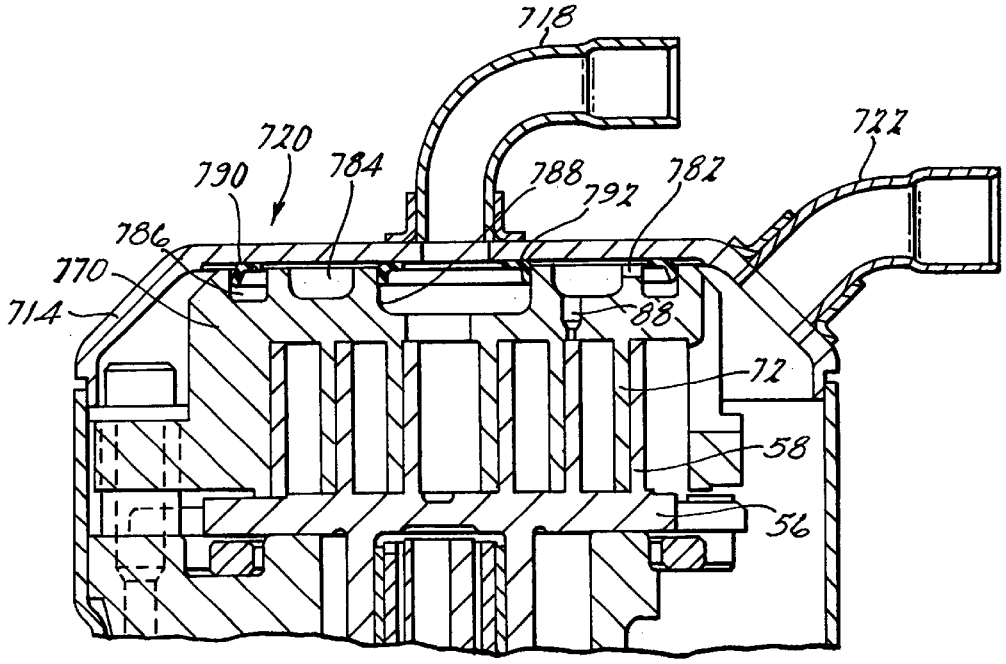
FIG. 18 is a partial vertical sectional view of a scroll type refrigerant compressor incorporating a sealing system in accordance with another embodiment of the present invention.

Referring now to FIG. 18, a sealing system 720 in accordance with another embodiment of the present invention is illustrated. Sealing system 720 seals fluid pressure between a cap 714 and a non-orbiting scroll member 770. A discharge fitting 718 and a suction fitting 722 are secured to cap 714 to provide for a direct discharge scroll compressor and for providing for the return of the decompressed gas to the compressor. Non-orbiting scroll member 770 is designed to replace non-orbiting scroll member 70 or any other of the non-orbiting scroll members described. As shown in FIG. 18, a partition between the suction pressure zone and the discharge pressure zone of the compressor has been eliminated due to sealing system 720 being disposed between cap 714 and non-orbiting scroll member 770.

Non-orbiting scroll member 770 includes scroll wrap 72 and it defines an annular recess 784, an outer seal groove 786 and an inner seal groove 788. A passage 782 interconnects annular recess 784 with outer seal groove 786. Annular chamber 784 is located between outer seal groove 786 and inner seal groove 788 and it is provided compressed fluid through fluid passage 88 which opens to a fluid pocket defined by non-orbiting scroll wrap 72 of non-orbiting scroll member 770 and orbiting scroll wrap 58 of orbiting scroll member 56. The pressurized fluid provided through fluid passage 88 is at a pressure which is intermediate or in between the suction pressure and the discharge pressure of the compressor. The fluid pressure within annular chamber 784 biases non-orbiting scroll member 770 towards orbiting scroll member 56 to enhance the tip sealing characteristics between the two scroll members.

A flip seal 790 is disposed within outer seal groove 786 and a flip seal 792 is disposed within inner seal groove 788. Flip seal 790 sealing engages non-orbiting scroll member 770 and cap 714 to isolate annular recesses 784 from suction pressure. Flip seal 792 sealingly engages non-orbiting scroll member 770 and cap 714 to isolate annular recesses 784 from discharge pressure. While not illustrated in FIG. 18, non-orbiting scroll member 770 can include temperature protection system 110 and/or pressure relief system 112 if desired.

Figure 19:
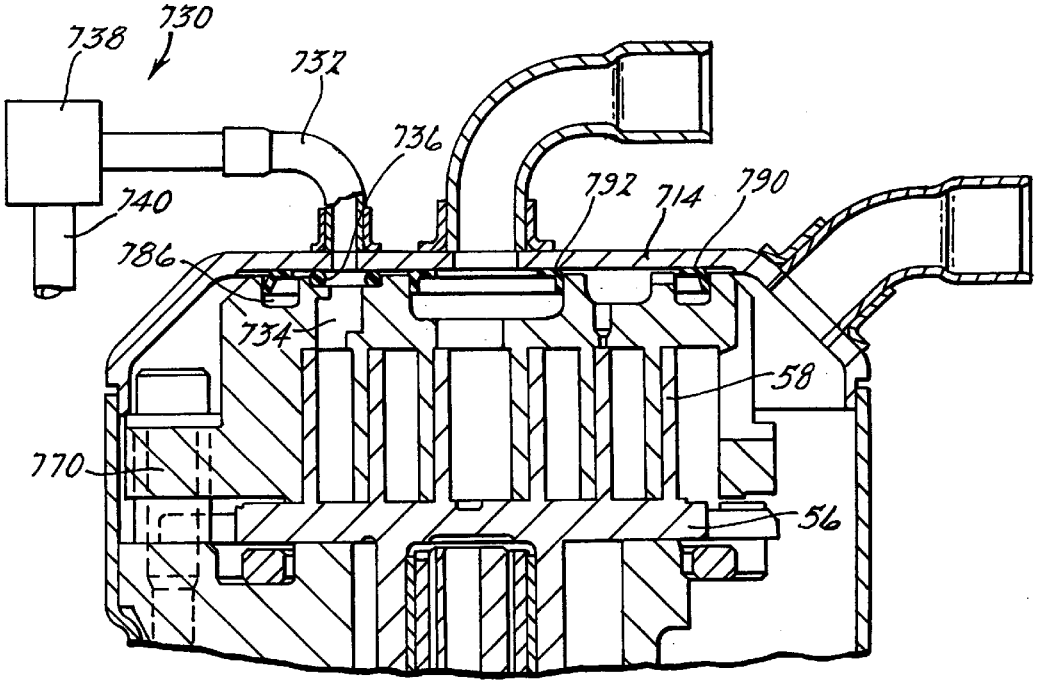
FIG. 19 is a partial vertical sectional view similar to FIG. 18 but also incorporating a capacity modulation system.

Referring now to FIG. 19, the compressor illustrated in FIG. 18 is shown incorporating a vapor injection system 730. Vapor injection system 730 includes an injection pipe 732 which extends through cap 714 and is in communication with a vapor injection passage 734 extending through non-orbiting scroll member 770. A flat top seal 736 seals the interface between injection pipe 732 and non-orbiting scroll member 770 as well as providing a seal between vapor injection passage 734 and annular recess 786. Vapor injection passage 734 is in communication with one or more of the fluid pockets formed by scroll wraps 72 and 58 of scroll members 770 and 56, respectively. Vapor injection system 730 further comprises a valve 738, which is preferably a solenoid valve, and a connection pipe 740 which leads to a source of compressed vapor. When additional capacity for the compressor is required, vapor injection system 730 can be activated to inject pressurized vapor into the compressor as is well known in the art. Vapor injection systems are well known in the art so a full discuss of the system will not be included herein. By operating vapor injection system in a pulse width modulation mode, the capacity of the compressor can be increased incrementally between its full capacity and a capacity above its full capacity as provided by vapor injection system 730.

Figure 20:
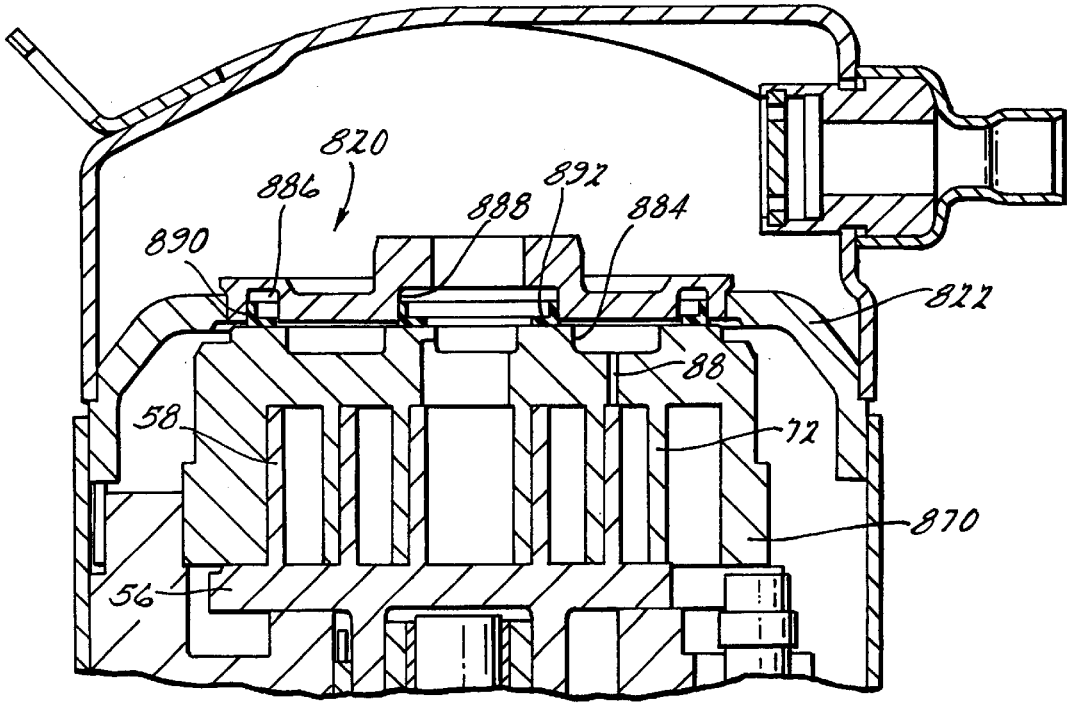
FIG. 20 is a partial vertical sectional view of a scroll type refrigerant compressor incorporating a sealing system in accordance with another embodiment of the present invention.

Referring now to FIG. 20, a sealing system 820 in accordance with the present invention is illustrated. Sealing system 820 seals fluid pressure between a partition 822 and a non-orbiting scroll member 870. Non-orbiting scroll member 870 is designed to replace non-orbiting scroll member 70 or any other of the non-orbiting scroll members described. Partition 822 is designed to replace partition member 22 or any other of the partitions described.

Non-orbiting scroll member 870 includes scroll wrap 72 and it defines an annular chamber 884. Partition 822 defines an outer seal groove 886 and an inner seal groove 888. Annular chamber 884 is located between outer seal groove 886 and inner seal groove 888 and it is provided compressed fluid through fluid passage 88 which opens to a fluid pocket defined by non-orbiting scroll wrap 72 of non-orbiting scroll member 870 and orbiting scroll wrap 58 of orbiting scroll member 56. The pressurized fluid provided through fluid passage 88 is at a pressure which is intermediate or in between the suction pressure and the discharge pressure of the compressor. The fluid pressure within annular chamber 884 biases non-orbiting scroll member 870 towards orbiting scroll member 56 to enhance the tip sealing characteristics between the two scroll members.

A flip seal 890 is disposed within outer seal groove 886 and a flip seal 892 is disposed within inner seal groove 888. Flip seal 890 engages non-orbiting scroll member 870 and partition 822 to isolate annular chamber 884 from suction pressure. Flip seal 892 sealingly engages non-orbiting scroll member 870 and partition 822 to isolate annular chamber 884 from discharge pressure. While not illustrated in FIG. 20, non-orbiting scroll member 870 can include temperature protection system 110. Also, while not illustrated, non-orbiting scroll member 870 can also include pressure relief system 112 if desired.

Figure 21:
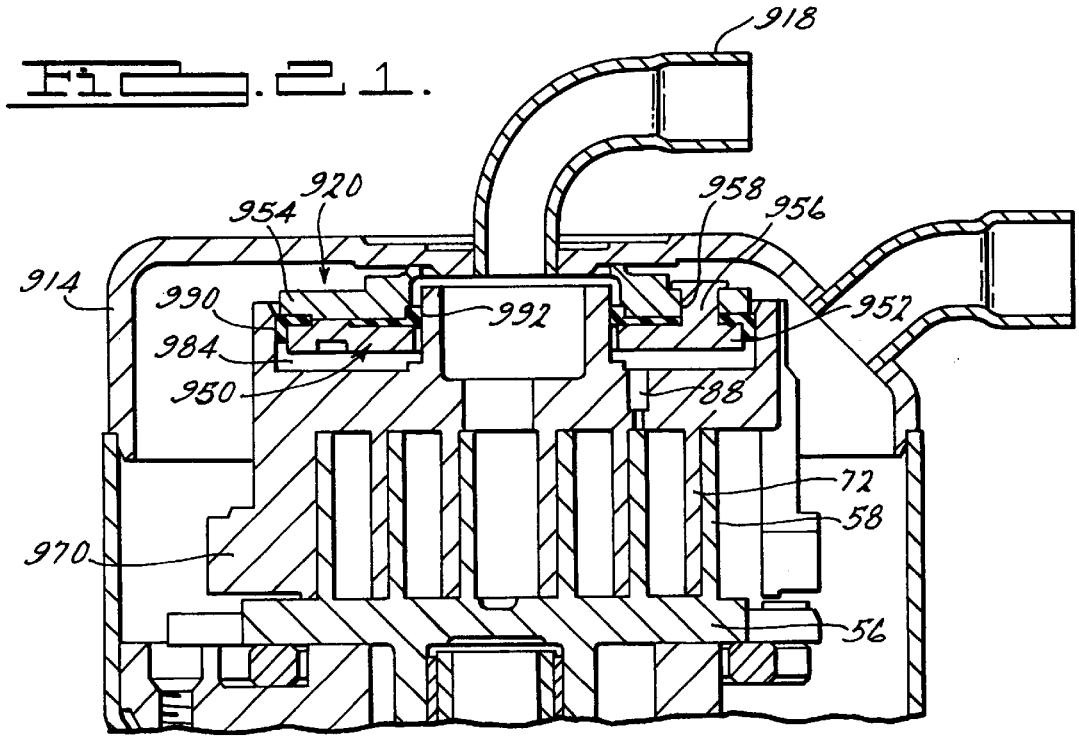
FIG. 21 is a partial vertical sectional view of a scroll type refrigerant compressor incorporating a sealing system in accordance with another embodiment of the present invention.

Referring now to FIG. 21, a sealing system 920 in accordance with another embodiment of the present invention is illustrated. Sealing system 920 seals fluid pressure between a cap 914 and a non-orbiting scroll member 970. A discharge fitting 918 is secured to cap 914 to provide for a direct discharge scroll compressor. Non-orbiting scroll member 970 is designed to replace non-orbiting scroll member 70 or any other of the non-orbiting scroll members described. As shown in FIG. 21, a partition between the suction pressure zone and the discharge pressure zone of the compressor has been eliminated due to sealing system 920 being disposed between cap 914 and non-orbiting scroll member 970.

Non-orbiting scroll member 970 includes scroll wrap 72 and it defines an annular recess 984. Disposed within annular recess 984 is a floating seal 950. The basic concept for floating seal 950 with axial pressure biasing is disclosed in much greater detail in Assignee's U.S. Pat. No. 4,877,382, the disclosure of which is incorporated herein by reference. Floating seal 950 comprises a base ring 952, a sealing ring 954, an outer flip seal 990 and an inner flip seal 992. Flip seals 990 and 992 are sandwiched between rings 952 and 954 and are held in place by a plurality of posts 956 which are an integral part of base ring 952. Sealing ring 954 includes a plurality of holes 958 which correspond with the plurality of posts 956. Once base ring 952, seals 990 and 992 and sealing ring 954 are assembled, posts 956 are mushroomed over to complete the assembly of floating seal 950. While seals 990 and 992 are described as being separate components, it is within the scope of the present invention to have a single piece component provide seals 990 and 992 with this single piece component including a plurality of holes which correspond with the plurality of posts 956.

Annular recess 984 is provided compressed fluid through fluid passage 88 which opens to a fluid pocket defined by non-orbiting scroll wrap 72 of non-orbiting scroll member 970 and orbiting scroll wrap 58 of orbiting scroll member 56. The pressurized fluid provided through fluid passage 88 is at a pressure which is intermediate or in between the suction pressure and the discharge pressure of the compressor. The fluid pressure within annular recess 984 biases non-orbiting scroll member 970 towards orbiting scroll member 56 to enhance the tip sealing characteristics between the two scroll members. In addition, fluid pressure within annular recess 984 biases floating seal member 950 against upper cap 914 of the compressor. Sealing ring 954 engages upper cap 914 to seal the suction pressure area of the compressor from the discharge area of the compressor. Flip seal 990 sealingly engages non-orbiting scroll member 970 and rings 952 and 954 to isolate annular recess 984 from suction pressure. Flip seal 992 sealingly engages non-orbiting scroll member 970 and rings 952 and 954 to isolate annular recess 984 from discharge pressure. While not specifically illustrated in FIG. 21, non-orbiting scroll member 970 can include temperature protection system 110 and/or pressure relief system 112.

Figure 22:
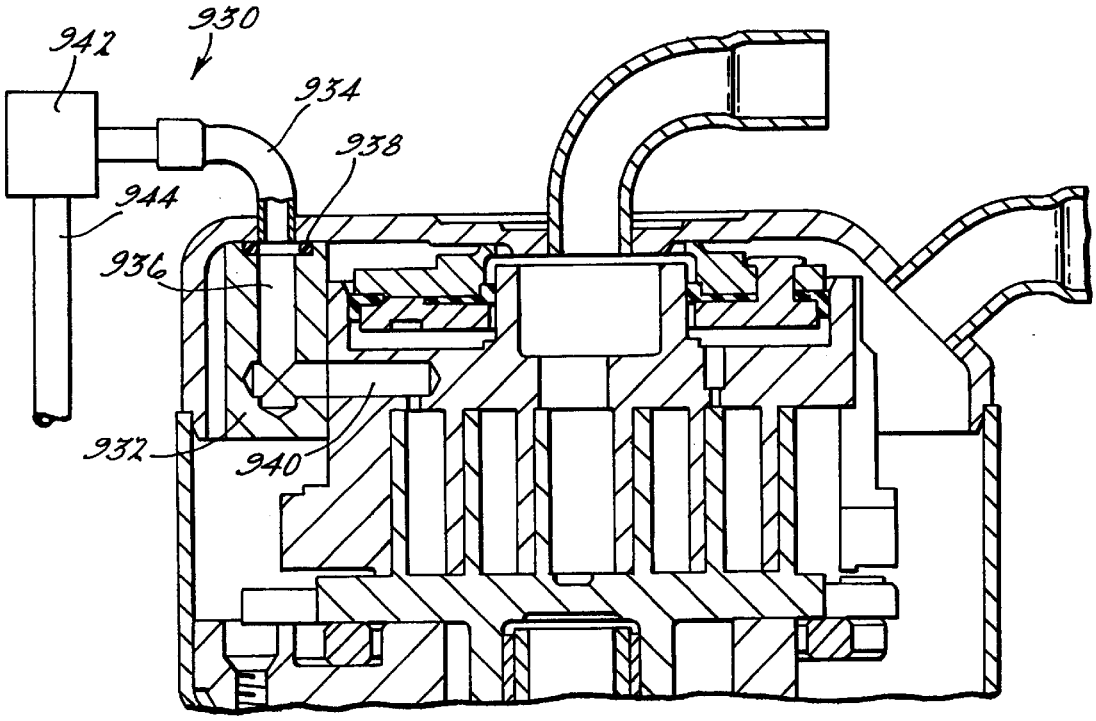
FIG. 22 is a partial vertical sectional view similar to FIG. 21 but also incorporating a capacity modulation system.

Referring now to FIG. 22, the compressor illustrated in FIG. 21 is shown incorporating a vapor injection system 930. Vapor injection system 930 comprises a coupling 932 and an injection pipe 934. Injection pipe 934 extends through cap 914 and is in communication with a vapor injection passage 936 extending through coupling 932. A flip seal 938 seals the interface between coupling 932 and injection pipe 934. Vapor injection passage 936 is in communication with a vapor injection passage 940 which extends through non-orbiting scroll member 970 to open into one or more of the fluid pockets formed by scroll wraps 72 and 58 of scroll members 970 and 56, respectively. Vapor injection system 930 further comprises a valve 942 which is preferably a solenoid valve and a connection pipe 944 which leads to a source of compressed vapor. When additional capacity for the compressor is received, vapor injection system 930 can be activated to inject pressurized vapor into the compressor as is well known in the art. Vapor injection systems are well known in the art so a full discussion of the system will not be included herein. By operating vapor injection system 930 in a pulse width modulation mode, the capacity of the compressor can be increased incrementally between its full capacity and a capacity above its full capacity as provided by vapor injection system 930.

Referring now to FIGS. 23A–23H, various configurations for the seal grooves described above are illustrated. FIG.

Figure 23A:
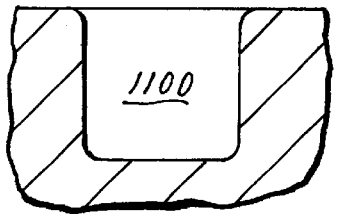
FIGS. 23A–23H are enlarged sectional views illustrating various seal groove geometries in accordance with the present invention.
Figure 23B:
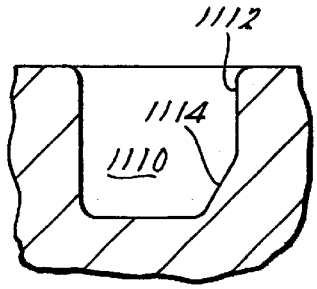
Figure 23C:
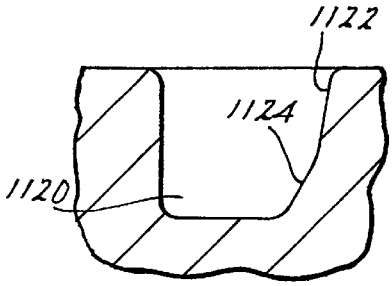

23A illustrates a seal groove 1100 having a rectangular configuration. FIG. 23B illustrates a seal groove 1110 having one side defining a straight portion 1112 and a tapered portion 1114. This is the preferred groove geometry with the edge of the seal assembled within groove 1110 sealing against either one of portions 1112 or 1114. The other side of groove 1110 is a straight wall. FIG. 23C illustrates a seal groove 1120 having one side defining a first tapered portion 1122 and a second tapered portion 1124. The edge of the seal assembled within groove 1120 seals against either one of portions 1122 or 1124. The other side of groove 1120 is a straight wall.

Figure 23D:
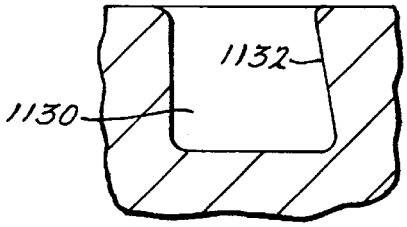
Figure 23E:
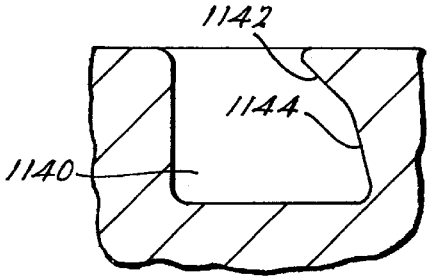
Figure 23F:
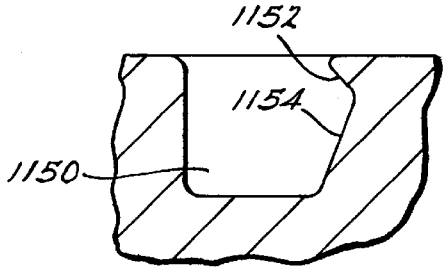

FIG. 23D illustrates a seal groove 1130 having one side defining a reverse tapered wall 1132. The edge of the seal assembled within groove 1130 seals against reverse tapered wall 1132. The other side of groove 1130 is a straight wall. FIG. 23E illustrates a seal groove 1140 having one wall defining a first reverse tapered portion 1142 and a second reverse tapered portion 1144. The edge of the seal assembled within groove 1140 seals against either one of portions 1142 or 1144. The other side of groove 1140 is a straight wall. FIG. 23F illustrates a seal groove 1150 having one side defining a reverse tapered portion 1152 and a tapered portion 1154. The edge of the seal assembled within groove 1150 seals against either one of portions 1152 or 1154. The other side of groove 1150 is a straight wall.

Figure 23G:
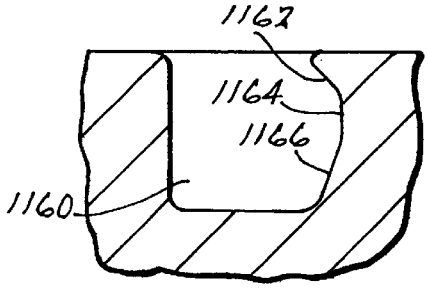
Figure 23H:
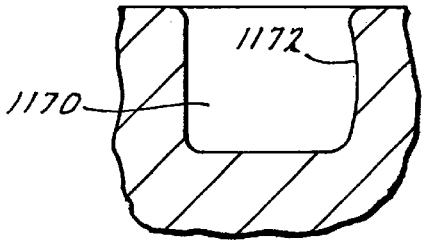

FIG. 23G illustrates a seal groove 1160 having one side defining a reverse tapered portion 1162, a straight portion 1164 and a tapered portion 1166. The edge of the seal assembled within groove 1160 seals against either one of portions 1162,1164 or 1166. The other side of seal groove 1160 is a straight wall. FIG. 23H illustrates a seal groove 1170 having one side defining a curved wall 1172. The edge of the seal assembled within groove 1170 seals against curved wall 1172. The other side of seal groove 1170 is straight.

Figure 24:
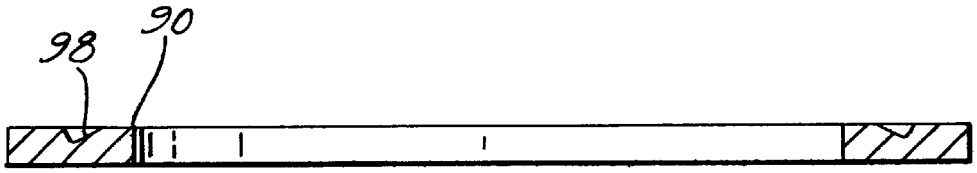
FIG. 24 is a cross-sectional view of an as-molded flat top seal.
Figure 25:
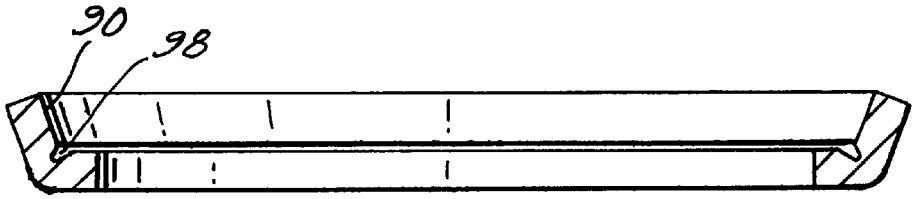
FIG. 25 is a cross-sectional view of a flip seal in it L-shaped operational condition.

Referring now to FIGS. 24 and 25, flip seal 90 is illustrated. FIG. 24 illustrates flip seal 90 in an as molded condition. Flip seal 90 is molded preferably from a Teflon® material containing 10% when it is interfacing with a steel component. Flip seal 90 is molded in an annular shape as shown in FIG. 24 with a notch 98 extending into one surface thereof. Notch 98 facilitates the bending of flip seal 90 into its L-shaped configuration as shown in FIG. 25. While FIGS. 24 and 25 illustrate flat top seal 90, it is to be understood that flip seals 92, 94, 490, 492, 590, 592, 690, 692, 790, 792, 890, 892, 990 and 992 are all manufactured with notch 98.

While not specifically illustrated, vapor injection systems 730 and 930 can be designed to provide for delayed suction closing instead of vapor injection. When designed for delayed suction closing, system 730 and 930 would extend between one of the closed pockets defined by the scroll wraps and the suction area of the compressor. The delayed suction closing systems provide for capacity modulation as is well known in the art and can also be operated in a pulse width modulation manner. In addition, the vapor injection system illustrated in FIGS. 19 and 22 can be incorporated into any of the embodiments of the invention illustrated.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having a first spiral wrap projecting outwardly from a first end plate;

a second scroll member having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a plate member having first and second generally flat portions disposed adjacent said first scroll member, said entire first scroll member being covered by said plate member;

a discharge passage placing one of said pockets in fluid communication with said discharge pressure zone, said discharge passage extending through said plate member and said first end plate;

a first annular lip seal disposed between said first generally flat portion of said plate member and said first end plate and surrounding said discharge passage;

a second annular lip seal disposed between said second generally flat portion of said plate member and said first end plate and surrounding said first annual lip seal, thereby defining a chamber between said annular lip seals; and a passage for placing compressed fluid at a pressure intermediate said suction pressure and said discharge pressure in fluid communication with said chamber to pressure bias said first scroll member toward said second scroll member.

2. A scroll machine according to claim 1 wherein said first and second flat portions lie in spaced parallel planes.

3. A scroll machine according to claim 1 wherein said first and second flat portions lie in the same plane.

4. A scroll machine according to claim 1 wherein one of said first and second annular lip seals is disposed within a seal groove.

5. A scroll machine according to claim 4 wherein said seal groove is disposed within said first scroll member.

6. A scroll machine according to claim 4 wherein said seal groove is disposed within said plate member.

7. A scroll machine according to claim 4 wherein said seal groove is generally rectangular in shape.

8. A scroll machine according to claim 4 wherein said seal groove includes a wall which defines a tapered portion.

9. A scroll machine according to claim 4 wherein said seal groove includes a wall which defines a double tapered portion.

10. A scroll machine according to claim 4 wherein said seal groove includes a wall which defines a reverse taper.

11. A scroll machine according to claim 4 wherein said seal groove includes a wall which defines a reverse double taper.

12. A scroll machine according to claim 4 wherein said seal groove includes a wall which defines a reverse lip.

13. A scroll machine according to claim 4 wherein said seal groove includes a wall which defines a first tapered portion, a flat portion and a second tapered portion.

14. A scroll machine according to claim 4 wherein said seal groove includes a wall which defines a curved portion.

15. A scroll machine according to claim 1 wherein one of said first and second annular lip seals is a one-way seal.

16. A scroll machine according to claim 1 wherein one of said first and second annular lip seals is an L-shaped seal.

17. A scroll machine according to claim 1 wherein one of said first and second annular lip seals defines a notch.

18. A scroll machine according to claim 1 wherein one of said first and second annular lip seals is manufactured from a tetrafluoroethylene polymer.

19. A scroll machine according to claim 1 wherein said scroll machine further comprises a vapor injection system.

20. A scroll machine according to claim 1 wherein said scroll machine further comprises a capacity modulation system.

21. A scroll machine comprising:

a first scroll member having a first spiral wrap projecting outwardly from a first end plate;

a second scroll member having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a plate member having a central portion disposed adjacent said first scroll member;

a discharge passage placing one of said pockets in fluid communication with said discharge pressure zone, said discharge passage extending through said plate member and said first end plate;

a first annular lip seal disposed between said plate member and said first end plate and surrounding said discharge passage;

a second annular lip seal disposed between said plate member and said first end plate and surrounding said first lip seal, thereby defining a first chamber between said first and second lip seals;

a third annular lip seal disposed between said plate member and said first end plate and surrounding said second lip seal, thereby defining a second chamber between said second and third lip seals; and passages for placing fluid being compressed in fluid communication with said first and second chambers to pressure bias said first scroll member toward said second scroll member.

22. A scroll machine according to claim 21 wherein said first and second flat portions lie in the same plane.

23. A scroll machine according to claim 21 wherein one of said first and second annular lip seals is disposed within a seal groove.

24. A scroll machine according to claim 23 wherein said seal groove is disposed within said first scroll member.

25. A scroll machine according to claim 23 wherein said seal groove is generally rectangular in shape.

26. A scroll machine according to claim 23 wherein said seal groove includes a wall which defines a tapered portion.

27. A scroll machine according to claim 23 wherein said seal groove includes a wall which defines a double tapered portion.

28. A scroll machine according to claim 23 wherein said seal groove includes a wall which defines a reverse taper.

29. A scroll machine according to claim 23 wherein said seal groove includes a wall which defines a reverse double taper.

30. A scroll machine according to claim 23 wherein said seal groove includes a wall which defines a reverse lip.

31. A scroll machine according to claim 23 wherein seal groove includes a wall which defines a first tapered portion, a flat portion and a second tapered portion.

32. A scroll machine according to claim 23 wherein said seal groove includes a wall which defines a curved portion.

33. A scroll machine according to claim 21 wherein one of said first and second annular lip seals is a one-way seal.

34. A scroll machine according to claim 21 wherein one of said first and second annular lip seals is an L-shaped seal.

35. A scroll machine according to claim 21 wherein one of said first and second annular lip seals defines a notch.

36. A scroll machine according to claim 21 wherein one of said first and second annular lip seals is manufactured from a tetrafluoroethylene polymer.

37. A scroll machine according to claim 21 wherein said scroll machine further comprises a vapor injection system.

38. A scroll machine according to claim 21 wherein said scroll machine further comprises a capacity modulation system.

39. A scroll machine comprising:

a first scroll member having a first spiral wrap projecting outwardly from a first end plate;

a second scroll member having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a partition having a central portion disposed between said discharge pressure zone and said suction pressure zone, said entire first scroll member being covered by said partition;

a discharge passage placing one of said pockets in fluid communication with said discharge pressure zone, said discharge passage extending through said central portion of said partition and said first end plate;

a first annular lip seal disposed between said central portion of said partition and said first end plate and surrounding said discharge passage;

a second annular lip seal disposed between said central portion of said partition and said first end plate and surrounding said first lip seal, thereby defining a chamber between said lip seals; and a passage for placing compressed fluid at a pressure intermediate said suction pressure and said discharge pressure in fluid communication with said chamber to pressure bias said first scroll member toward said second scroll member.

40. A scroll machine according to claim 39 wherein said first and second flat portions lie in spaced parallel planes.

41. A scroll machine according to claim 39 wherein said first and second flat portions lie in the same plane.

42. A scroll machine according to claim 39 wherein one of said first and second annular lip seals is disposed within a seal groove.

43. A scroll machine according to claim 42 wherein said seal groove is disposed within said first scroll member.

44. (currently amended) A scroll machine according to claim 42 wherein said seal groove is disposed within said partition.

45. A scroll machine according to claim 42 wherein said seal groove is generally rectangular in shape.

46. A scroll machine according to claim 42 wherein said seal groove includes a wall which defines a tapered portion.

47. A scroll machine according to claim 42 wherein said seal groove includes a wall which defines a double tapered portion.

48. A scroll machine according to claim 42 wherein said seal groove includes a wall which defines a reverse taper.

49. A scroll machine according to claim 42 wherein said seal groove includes a wall which defines a reverse double taper.

50. A scroll machine according to claim 42 wherein said seal groove includes a wall which defines a reverse lip.

51. A scroll machine according to claim 42 wherein said seal groove includes a wall which defines a first tapered portion, a flat portion and a second tapered portion.

52. A scroll machine according to claim 42 wherein said seal groove includes a wall which defines a curved portion.

53. A scroll machine according to claim 39 wherein one of said first and second annular lip seals is a one-way seal.

54. A scroll machine according to claim 39 wherein one of said first and second annular lip seals is an L-shaped seal.

55. A scroll machine according to claim 39 wherein one of said first and second annular lip seals defines a notch.

56. A scroll machine according to claim 39 wherein one of said first and second annular lip seals is manufactured from a tetrafluoroethylene polymer.

57. A scroll machine according to claim 39 wherein said scroll machine further comprises a vapor injection system.

58. A scroll machine according to claim 39 wherein said scroll machine further comprises a capacity modulation system.

59. A scroll machine comprising:

a shell having a top, a bottom and sides, said shell defining a hermetic chamber;

a first scroll member disposed in said hermetic chamber defined by said shell and having a first spiral wrap projecting outwardly from a first end plate;

a second scroll member disposed in said shell and having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a discharge passage placing one of said pockets in fluid communication with said discharge pressure zone, said discharge passage extending through said top of said shell and said first end plate;

a first annular lip seal disposed between said top of said shell and said first end plate and surrounding said discharge passage;

a second annular lip seal engaging both said top of said shell and said first end plate and surrounding said first lip seal, thereby defining a chamber between said lip seals; and a passage for placing compressed fluid at a pressure intermediate said suction pressure and said discharge pressure in fluid communication with said chamber to pressure bias said first scroll member toward said second scroll member.

60. A scroll machine according to claim 59 wherein said first and second flat portions lie in the same plane.

61. A scroll machine according to claim 59 wherein one of said first and second annular lip seals is disposed within a seal groove.

62. A scroll machine according to claim 61 wherein said seal groove is disposed within said first scroll member.

63. A scroll machine according to claim 61 wherein said seal groove is generally rectangular in shape.

64. A scroll machine according to claim 61 wherein said seal groove includes a wall which defines a tapered portion.

65. A scroll machine according to claim 61 wherein said seal groove includes a wall which defines a double tapered portion.

66. A scroll machine according to claim 61 wherein said seal groove includes a wall which defines a reverse taper.

67. A scroll machine according to claim 61 wherein said seal groove includes a wall which defines a reverse double taper.

68. A scroll machine according to claim 61 wherein said seal groove includes a wall which defines a reverse lip.

69. A scroll machine according to claim 61 wherein said seal groove includes a wall which defines a first tapered portion, a flat portion and a second tapered portion.

70. A scroll machine according to claim 61 wherein said seal groove includes a wall which defines a curved portion.

71. A scroll machine according to claim 59 wherein one of said first and second annular lip seals is a one-way seal.

72. A scroll machine according to claim 59 wherein one of said first and second annular lip seals is an L-shaped seal.

73. A scroll machine according to claim 59 wherein one of said first and second annular lip seals defines a notch.

74. A scroll machine according to claim 59 wherein said scroll machine further comprises a vapor injection system.

75. A scroll machine according to claim 59 wherein said scroll machine further comprises a capacity modulation system.

76. (currently amended) A scroll machine comprising:

a first scroll member having a first spiral wrap projecting outwardly from a first end plate;

a second scroll member having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a plate member disposed adjacent said first scroll member;

a discharge passage placing one of said pockets in fluid communication with said discharge pressure zone, said discharge passage extending through said plate member and said first end plate;

a chamber defined by said first scroll member;

a floating seal disposed within said chamber, said floating seal engaging said plate member;

a first annular lip seal disposed between said floating seal and aid said first scroll member, said first annular lip seal having an L-shaped cross-section and surrounding said discharge passage;

a second annular lip seal disposed between said floating seal and said first scroll member, said second annular lip seal having an L-shaped cross-section and surrounding said first annular lip seal; and a passage for placing compressed fluid at a pressure intermediate said suction pressure and said discharge pressure in fluid communication with said chamber to pressure bias said first scroll member toward said second scroll member.

77. A scroll machine according to claim 76 wherein one of said first and second annular lip seals is a one-way seal.

78. A scroll machine according to claim 76 wherein one of said first and second annular lip seals defines a notch.

79. A scroll machine according to claim 76 wherein one of said first and second annular lip seals is manufactured from a tetrafluoroethylene polymer.

80. A scroll machine according to claim 76 wherein said scroll machine further comprises a vapor injection system.

81. A scroll machine according to claim 76 wherein said scroll machine further comprises a capacity modulation system.

82. A scroll machine comprising:

a first scroll member having a first spiral wrap projecting outwardly from a first end plate;

a second scroll member having a second spiral wrap projecting outwardly from a second end plate, said second spiral wrap being interleaved with said first spiral wrap;

a drive member for causing said spiral wraps to orbit with respect to one another whereby said spiral wraps create pockets of progressively changing volume between a suction pressure zone at a suction pressure and a discharge pressure zone at a discharge pressure;

a plate member having first and second generally flat portions disposed adjacent said first scroll member;

a discharge passage placing one of said pockets in fluid communication with said discharge pressure zone, said discharge passage extending through said plate member and said first end plate;

a first annular lip seal disposed between said first generally flat portion of said plate member and said first end plate and surrounding said discharge passage;

a second annular lip seal disposed between said second generally flat portion of said plate member and said first end plate and surrounding said first annular lip seal, thereby defining a chamber between said annular lip seals;

a seal groove defined by one of said first scroll member and said plate member, one of said first and second annular lip seals being disposed within said seal groove, said seal groove having a larger diameter than a diameter of said one annular lip seal in a free state.

83. A scroll machine according to claim 82 wherein said first and second flat portions lie in spaced parallel planes.

84. A scroll machine according to claim 82 wherein said first and second flat portions lie in the same plane.

85. A scroll machine according to claim 82 wherein said seal groove is generally rectangular in shape.

86. A scroll machine according to claim 82 wherein said seal groove includes a wall which defines a tapered portion.

87. A scroll machine according to claim 82 wherein said seal groove includes a wall which defines a double tapered portion.

88. A scroll machine according to claim 82 wherein said seal groove includes a wall which defines a reverse taper.

89. A scroll machine according to claim 82 wherein said seal groove includes a wall which defines a reverse double taper.

90. A scroll machine according to claim 82 wherein said seal groove includes a wall which defines a reverse lip.

91. A scroll machine according to claim 82 wherein said seal groove includes a wall which defines a first tapered portion, a flat portion and a second tapered portion.

92. A scroll machine according to claim 82 wherein said seal groove includes a wall which defines a curved portion.

93. A scroll machine according to claim 82 wherein one of said first and second annular lip seals is a one-way seal.

94. A scroll machine according to claim 82 wherein one of said first and second annular lip seals is an L-shaped seal.

95. A scroll machine according to claim 82 wherein one of said first and second annular lip seals defines a notch.

96. A scroll machine according to claim 82 wherein one of said first and second annular lip seals is manufactured from a tetrafluoroethylene polymer.

97. A scroll machine according to claim 82 wherein said scroll machine further comprises a vapor injection system.

98. A scroll machine according to claim 82 wherein said scroll machine further comprises a capacity modulation system.

* * * * *

UNITED STATES PATENT AND TRADEMARK OFFICE

CERTIFICATE OF CORRECTION

PATENT NO. : 6,679,683 B2 
DATED : January 20, 2004
INVENTOR(S) : Stephen M. Seibel, Michael M. Perevozchikov and Norman Beck It is certified that error appears in the above-identified patent and that said Letters Patent is hereby corrected as shown below:

Title page,
Item [57], ABSTRACT,
Line 10, "ration" should be -- ratio --.

Column 1,
Line 12, (first occurrence), delete "to".

Column 2,
Line 16, "assembly" should be -- assemble --.
Line 45, "lossed" should be -- lost --.

Column 4,
Line 30, "it" should be -- its --.

Column 6,
Line 63, "then" should be -- than --.

Column 11,
Line 10, "sealing" should be -- sealingly --.
Line 40, "scaling" should be -- sealing --.

Column 12,
Lines 13 and 53, "sealing" should be -- sealingly --.

Column 13,
Line 12, "discuss" should be -- discussion --.

Column 16,
Line 24, "annual" should be -- annular --.
Line 25, after "a" insert -- first --.

Column 17,
Line 63, after "wherein" insert -- said --.

Column 18,
Line 56, delete "(currently amended)".

UNITED STATES PATENT AND TRADEMARK OFFICE

CERTIFICATE OF CORRECTION

PATENT NO. : 6,679,683 B2
DATED : January 20, 2004
INVENTOR(S) : Stephen M. Seibel, Michael M. Perevozchikov and Norman Beck It is certified that error appears in the above-identified patent and that said Letters Patent is hereby corrected as shown below:

Column 20,
Line 26, delete "(currently amended)".
Line 49, after "and" delete "aid".

Signed and Sealed this

Thirty-first Day of August, 2004

JON W. DUDAS
*Director of the United States Patent and Trademark Office*